US007814708B2

(12) United States Patent
Rivera, Jr. et al.

(10) Patent No.: US 7,814,708 B2
(45) **Date of Patent: *Oct. 19, 2010**

(54) PORTABLE RISER APPARATUS HAVING A LIFTING AND LOCKING ASSEMBLY

(75) Inventors: Jeremias C. Rivera, Jr., Elmhurst, IL (US); John Daniel Lazar, Munster, IN (US); Doss Samikkannu, Des Plaines, IL (US)

(73) Assignee: Midwest Folding Products, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/454,079

(22) Filed: May 12, 2009

(65) Prior Publication Data

US 2009/0249713 A1 Oct. 8, 2009

Related U.S. Application Data

(63) Continuation of application No. 10/788,068, filed on Feb. 26, 2004, now Pat. No. 7,546,705.

(60) Provisional application No. 60/450,300, filed on Feb. 26, 2003.

(51) Int. Cl.
*E04H 3/28* (2006.01)
*E04H 3/30* (2006.01)

(52) U.S. Cl. ..... 52/10; 52/9; 52/7; 182/132

(58) Field of Classification Search ..... 52/10, 52/9, 7, 36.1, 67, 118; 182/113, 132, 152
See application file for complete search history.

(56) References Cited

U.S. PATENT DOCUMENTS 2,018,887 A 10/1935 Fowler
2,030,776 A 2/1936 Vance
2,354,906 A * 8/1944 Bailey et al. ..... 182/119
2,876,503 A 3/1959 MacKintosh
2,983,968 A 5/1961 Wurn
3,142,871 A 8/1964 Harms (Continued)

FOREIGN PATENT DOCUMENTS

DE 3514780 4/1986

(Continued)

*Primary Examiner*—Phi Dieu Tran A
(74) *Attorney, Agent, or Firm*—McDermott Will & Emery LLP

(57) ABSTRACT

There is provided a portable riser having an operator actuated lifting assist assembly operatively coupled to a riser deck. In one aspect, there is a first pivot mechanism coupled to a first support leg and adapted to initiate upward movement of the portable riser from a collapsed position when a downward force is applied to the first support leg, and a second pivot mechanism coupled to a second support leg and adapted to continue the upward movement. The lifting assist assembly provides a lifting force that continues upward movement to an upright position where the portable riser in locked. There is included a riser unlocking means for unlocking the lifting assist assembly. The portable riser remains in the upright position until the riser unlocking means is operated and a collapsing force is applied to the portable riser sufficient to overcome the lifting force and enable collapsed of the portable riser.

7 Claims, 19 Drawing Sheets

U.S. PATENT DOCUMENTS 3,747,706 A * 7/1973 Paine et al. ..... 182/113
3,747,708 A 7/1973 Wenger et al.
3,974,894 A 8/1976 Wenger et al.
RE30,830 E * 12/1981 Wenger et al. ..... 182/113
4,650,145 A 3/1987 Natzel et al.
4,951,781 A * 8/1990 Bliss ..... 182/152
4,979,340 A 12/1990 Wilson et al.
5,069,006 A 12/1991 Fujita
5,078,442 A 1/1992 Rau et al.
5,121,812 A * 6/1992 Ochiai et al. ..... 182/152
5,152,109 A 10/1992 Boers
D341,431 S 11/1993 Kniefel et al.
RE34,468 E 12/1993 Rau et al.
5,343,817 A 9/1994 Abraham et al.
5,357,876 A 10/1994 Kniefel et al.
5,381,873 A * 1/1995 Kniefel et al. ..... 182/152
5,435,027 A 7/1995 Bourgraf et al.
5,732,425 A 3/1998 Leung
5,769,560 A 6/1998 Quam
5,775,234 A 7/1998 Solomon et al.
5,787,647 A 8/1998 Dettmann et al.
5,901,505 A 5/1999 Dettmann et al.
6,003,270 A 12/1999 MacIntyre
6,006,680 A 12/1999 Quam et al.
6,106,186 A 8/2000 Taipale et al.
6,185,769 B1 2/2001 Larisey et al.
6,189,653 B1 * 2/2001 Laug ..... 182/152
6,499,258 B1 12/2002 Borglum
6,526,611 B2 3/2003 Flynn et al.
6,625,932 B1 9/2003 Littlefield
6,658,798 B1 12/2003 Frerichs et al.
6,708,454 B1 3/2004 Frerichs et al.
6,929,303 B1 8/2005 Sharples
7,131,151 B2 11/2006 Ferneau et al.
7,428,762 B1 * 9/2008 Kalies ..... 5/627
7,546,705 B1 6/2009 Rivera, Jr. et al.

FOREIGN PATENT DOCUMENTS

DE 3503769 8/1986

* cited by examiner

FIG. 7D - Detail D

DETAIL E

PORTABLE RISER APPARATUS HAVING A LIFTING AND LOCKING ASSEMBLY

CROSS-REFERENCE TO RELATED APPLICATIONS

This application is a continuation of U.S. patent application Ser. No. 10/788,068, filed Feb. 26, 2004 now U.S. Pat. No. 7,546,705, which claims the benefit of U.S. Provisional Patent Application No. 60/450,300, filed on Feb. 26, 2003, both of which are expressly incorporated herein by reference.

FEDERALLY SPONSORED RESEARCH OR DEVELOPMENT

Not Applicable.

TECHNICAL FIELD

The present invention relates generally to risers, staging structures and elevated platforms used in entertainment or institutional settings to support people or items at an elevation above the floor. More particularly, the present invention relates to a transportable or portable riser having a lifting assist and locking assembly that facilitates the set-up, use, operation and storage of the portable risers.

BACKGROUND OF THE INVENTION

Transportable or portable risers using telescoping braces are known. One such portable riser is disclosed in U.S. Pat. No. 5,381,873 for a Portable Riser Unit with a Telescoping Brace issued on Jan. 17, 1995 to Kniefel et al, and incorporated herein by reference. Portable risers typically comprise a series of stepped decks supported above the floor by a frame structure. Portable risers comprise separate or individual decks, platforms or riser cells of varying height that are connected to form a single stepped portable riser unit. The terms portable riser, transportable riser, riser, riser unit, portable riser unit or support platform are commonly used to described portable risers and are understood by those of ordinary skill in the art to be used interchangeably.

Typical risers are designed and built with the intent of being easy to transport in a folded or collapsed configuration and for rapid set-up to an upright locked use position. However, existing riser designs, such as that disclosed in U.S. Pat. No. 5,381,873, have a variety of drawbacks that remain unaddressed. For example, when setting up a transportable riser from an unfolded and collapsed position, existing portable risers typically require a considerable amount of force applied by an operator to "lift" the collapsed riser decks to an upright use position. The operator must bend his body over the riser unit, and activate a riser set-up mechanism while simultaneously applying a lifting force to lift the collapsed riser decks until the whole riser unit is upright and locked in a use position. The set-up process requires the exertion of force that is or can be awkward and physically uncomfortable for the operator especially since the operator must exert and apply a large set-up lifting force from a bent-over position. This portable riser set-up process exposes operators to possible back strain or injury. Further, the set-up process generally takes an extended time period to complete when carried out by one operator as the operator may proceed cautiously to avoid injury from application of the required set-up force.

In some instances, multiple operators may participate in the set-up process to speed up the set-up process of the portable riser units and to reduce operator injuries. Two or more operators provide the required set-up lifting force instead of one. This scenario can lead to faster set-up times and reduces operator injury rates but may be unduly expensive due to the labor cost of the additional operators.

Additionally, existing portable riser designs oftentimes unexpectedly and suddenly collapse during the set-up process when the portable riser is upright but not yet in a locked position. If the unlocked riser begins to collapse, the riser unit will completely and rapidly collapse unless the operator actively intervenes to slow the riser units' collapse by bending over the riser unit and applying a countervailing force to slowly lower the riser decks to the floor. Further, the sudden collapse of existing riser units can lead to floor damage where the riser unit is being set-up and added wear and tear on the riser unit itself.

Moreover, existing portable risers typically use operator actuated locking mechanisms to lock the potable riser in a locked upright use position. Existing locking mechanisms include hand-operated wedging locks and foot-operated latching mechanisms. These locking mechanisms typically use a telescoping tube that acts as a diagonal brace across the tubular space frame of the portable riser. The foot-operated latching mechanism can also use a spring-loaded pin and safety enclosure to additionally allow for convenient unlocking of the portable riser from the erect or use position. These operator actuated locking mechanisms highlight another drawback of existing portable risers. In existing portable riser designs, the locking mechanism is the only mechanism maintaining the portable riser in an upright and locked use position. A failure of the locking mechanism will lead to the sudden and unexpected collapse of the entire portable riser endangering and possibly injuring people standing on or in the vicinity of the portable riser.

There is thus a need for a transportable or portable riser having an improved lifting and locking assembly that will enable rapid and easy set-up of the portable riser from a folded and collapsed position to an upright locked use position with minimal operator actuation force and that can maintain the portable riser in the upright and locked use position in the event of failure of the locking mechanism.

SUMMARY OF THE INVENTION

The present invention provides an apparatus for a portable riser comprising an improved lifting assist and locking assembly that enables rapid and easy set-up of the portable riser from a collapsed position to an upright locked use position with minimal operator applied actuation force and that will maintain the portable riser in the upright and locked use position in the event of failure by the locking assembly. The improved lifting assist and locking assembly provides added strength, durability and stability to the portable riser and enhances the ability of an operator to quickly transport a folded and collapsed riser, and to quickly, easily and safely set-up and take down the portable riser.

There is provided a portable riser having a plurality of riser decks, each with a deck frame and a first and second support leg. The portable rise can assume a collapsed position and an upright position. The portable riser includes a user-actuated lifting assist assembly coupled to a riser deck. The lifting assist assembly is adapted to provide a riser lifting force to assist a user in moving the portable riser from a collapsed position to an upright position. The portable riser also includes a first pivot mechanism coupled to a first support leg of a riser deck that is adapted to initiate the upward movement of the portable riser from a collapsed position upon the application of a downward force on the first support leg by the user.

There is also a second pivot mechanism coupled to the second support leg that is adapted to supplement the upward movement of the portable riser to the upright position.

There is also provided a lifting assist assembly for use in lifting a portable riser to the upright position. The lifting assist assembly includes a telescoping cross-brace coupled to a riser deck and an extending device interiorly coupled to the telescoping cross-brace. The extending device is preferably a gas cylinder that is adapted to provide a riser lifting force to move the portable riser to the upright position. There is also a locking mechanism coupled to the telescoping cross-brace that is adapted to lock the portable riser in the upright position. The locking mechanism includes a spring-loaded locking pin operatively coupled with an inclined plane member having an inclined surface. The lifting assist assembly also includes a user-actuated riser unlocking means coupled to the inclined plane member and adapted to move the inclined plane member when the user operates the riser unlocking means, which then translates its movement via the inclined surface to the spring-loaded pin to thereby unlock the lifting assist assembly.

In one aspect of the present invention a lifting assist mechanism is provided having a gas assist cylinder to assist the operator in lifting the decks of a portable riser in the set-up of the riser.

In another aspect of the present invention a lifting assist mechanism is provided having a gas assist cylinder and a telescoping cross brace to assist the operator in lifting the decks of a portable riser in the set-up of the riser where the sections of the telescoping cross brace have a circular or four sided cross-sectional configuration.

In a further aspect of the present invention a lifting assist mechanism is provided that will bear a majority of the lifting force needed to raise the portable riser from a collapsed position thereby reducing the operator's physical strain and reducing operator injuries.

In an additional aspect of the present invention a portable riser is provided having a lifting assist and locking mechanism and feature that enables a single operator to set-up the portable riser with minimal force provided or exerted by the operator.

In still a further aspect of the present invention a portable riser is provided having a lifting assist and locking mechanism that enables a single operator in a substantially upright, standing or unbent body position to set-up the portable riser with minimal force provided or exerted by the operator.

In yet another aspect of the present invention a portable riser is provided having a lifting assist and locking mechanism that is lightweight and convenient so as to improve the portability or transportability of the portable riser unit.

In another aspect of the present invention a portable riser is provided having a lifting assist and locking mechanism that will assist in the safe breakdown of the portable riser into a folded transport position.

In an additional aspect of the present invention a portable riser is provided having a lifting assist and locking mechanism that will prevent the sudden, unexpected and unintentional collapse of the portable riser from the erect or use position in the event of failure of the locking mechanism.

In a further aspect of the present invention a portable riser is provided having a lifting assist and locking mechanism that has a break-down or unlocking mechanism located away from the floor and conveniently accessible to an operator for initiating a collapse or break down of the portable riser.

The following drawings and description set forth additional advantages and benefits of the invention. More advantages and benefits will be obvious from the description and may be learned by practice of the invention.

BRIEF DESCRIPTION OF THE DRAWINGS

The present invention may be better understood when read in connection with the accompanying drawings, of which:

FIG. 7D illustrates Detail D of a coupling bracket used to couple the two portable risers of FIG. 7B;

DETAILED DESCRIPTION

Figure 1A:
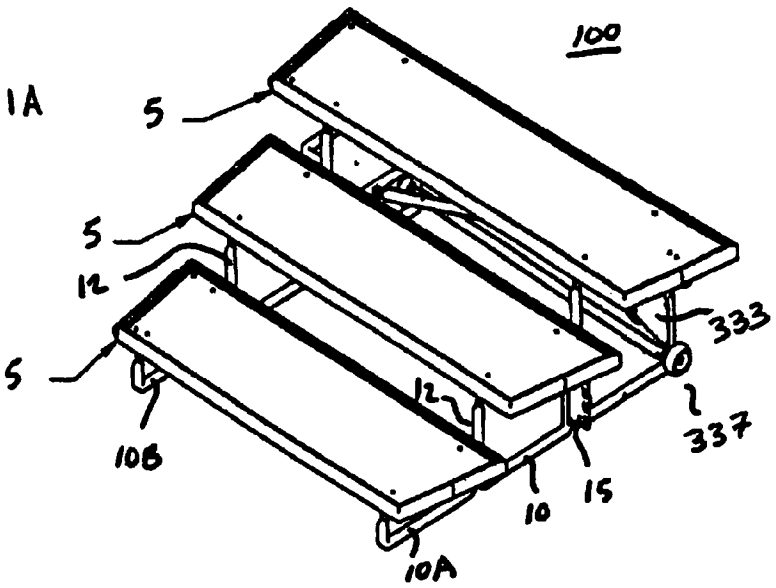
FIGS. 1A, 1B and 1C illustrate a front isometric, side and rear view of a portable riser in an upright and locked position according to an embodiment of the present invention.
Figure 1C:
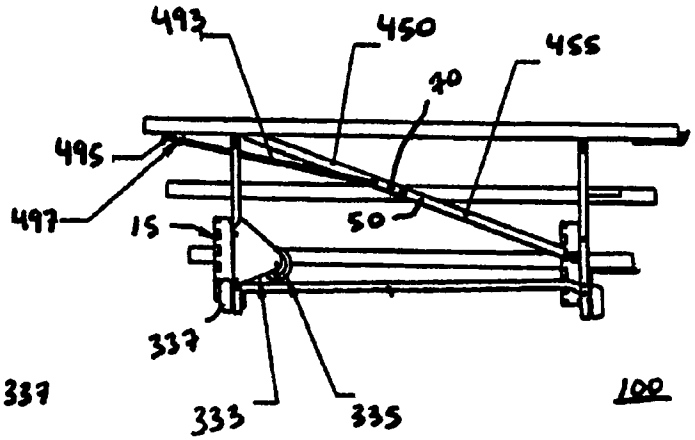
Figure 1B:
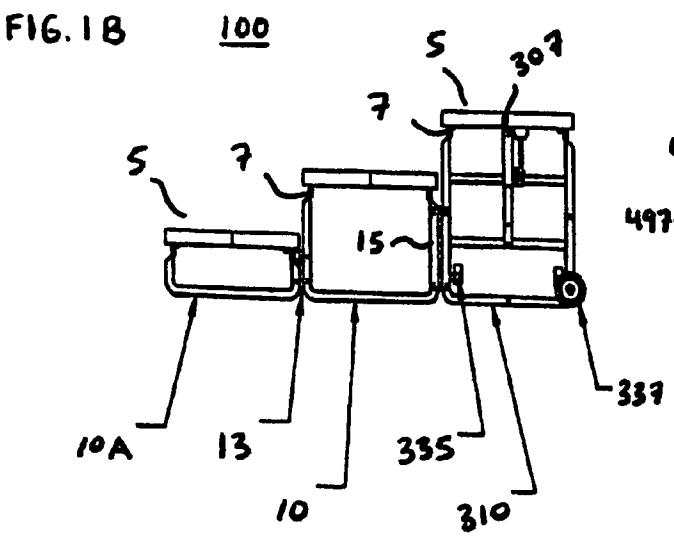
Figure 1D:
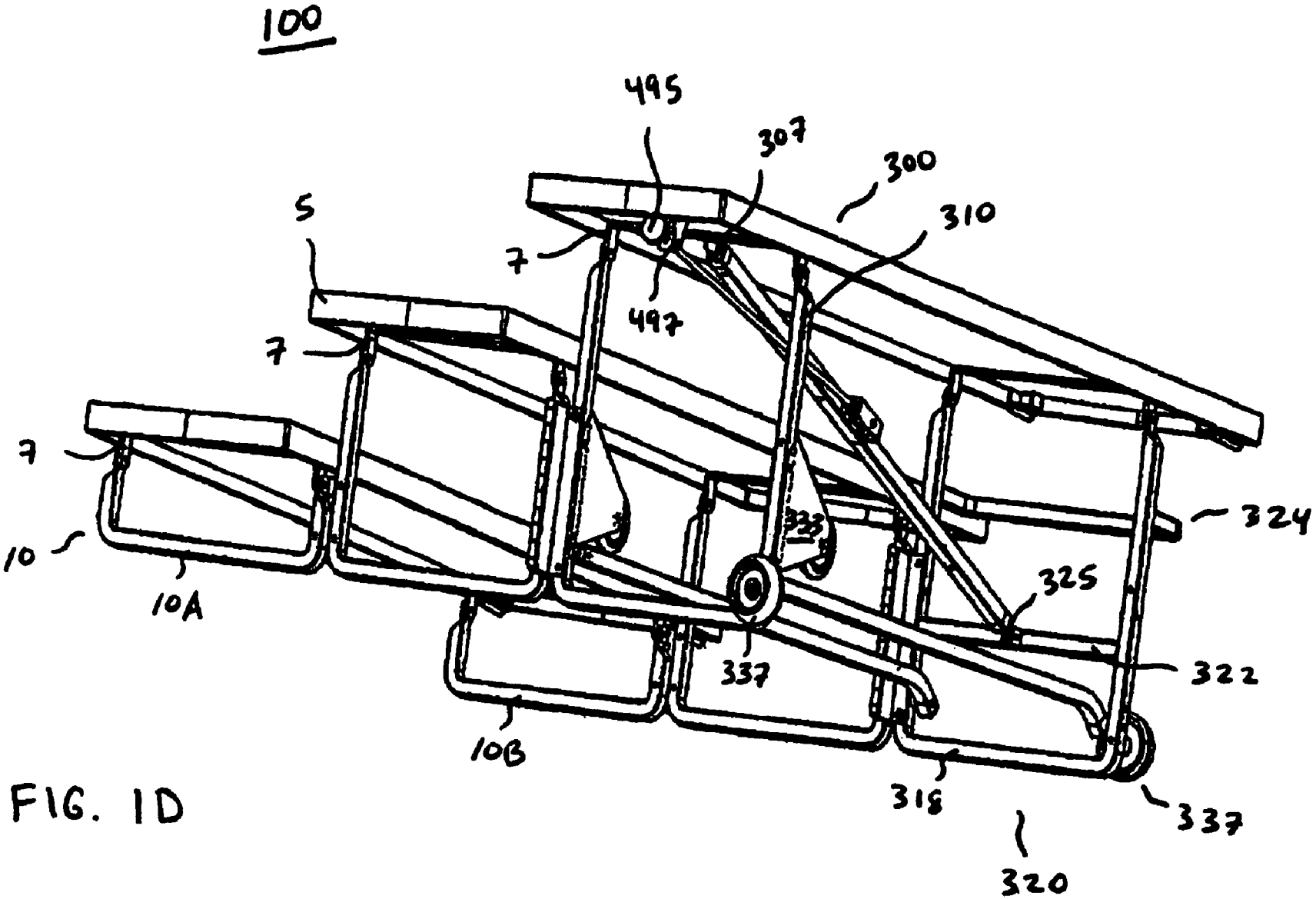
FIGS. 1D and 1E illustrate a rear isometric view of the upright and locked portable riser of FIGS. 1A-1C.
Figure 1E:
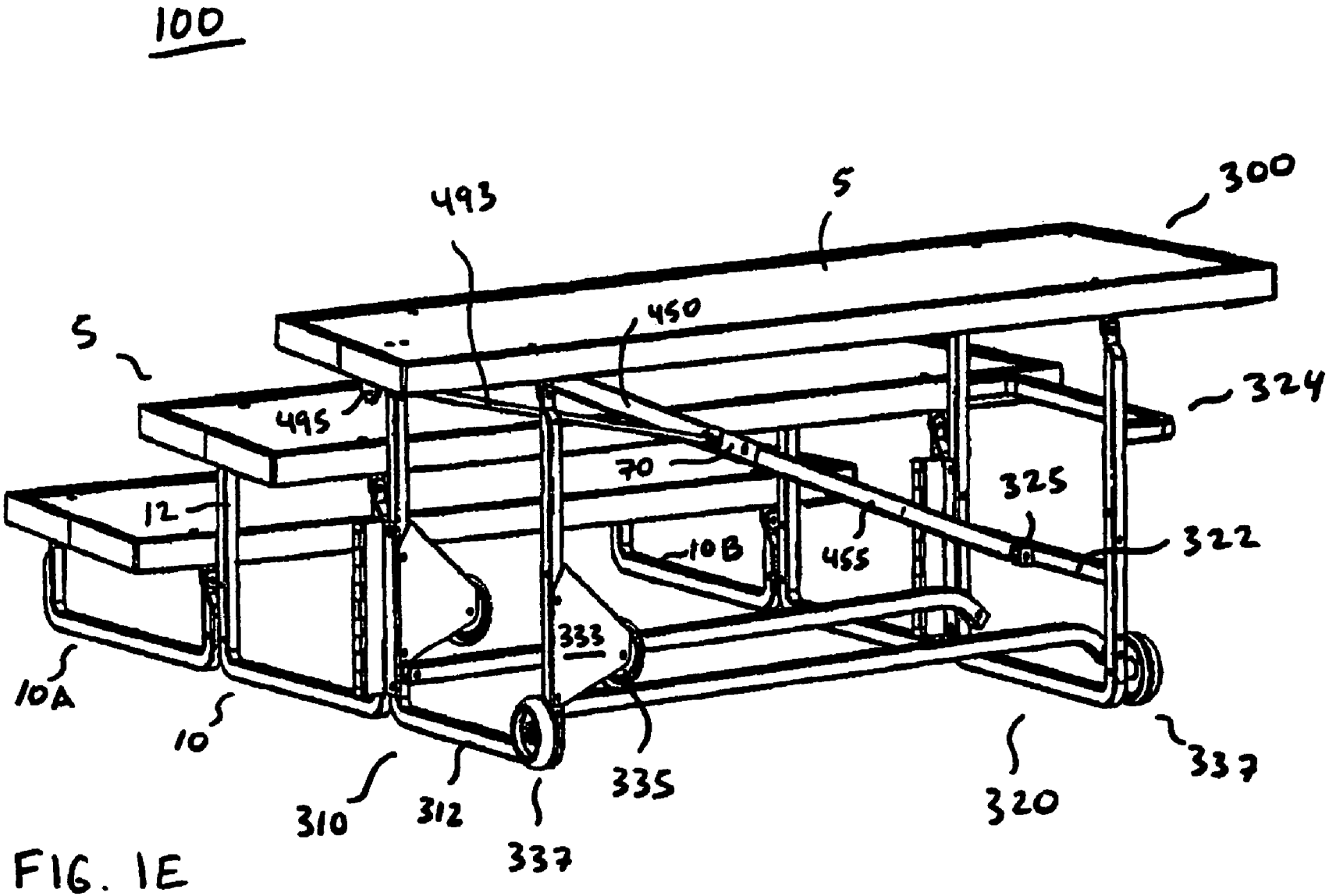
Figure 2:
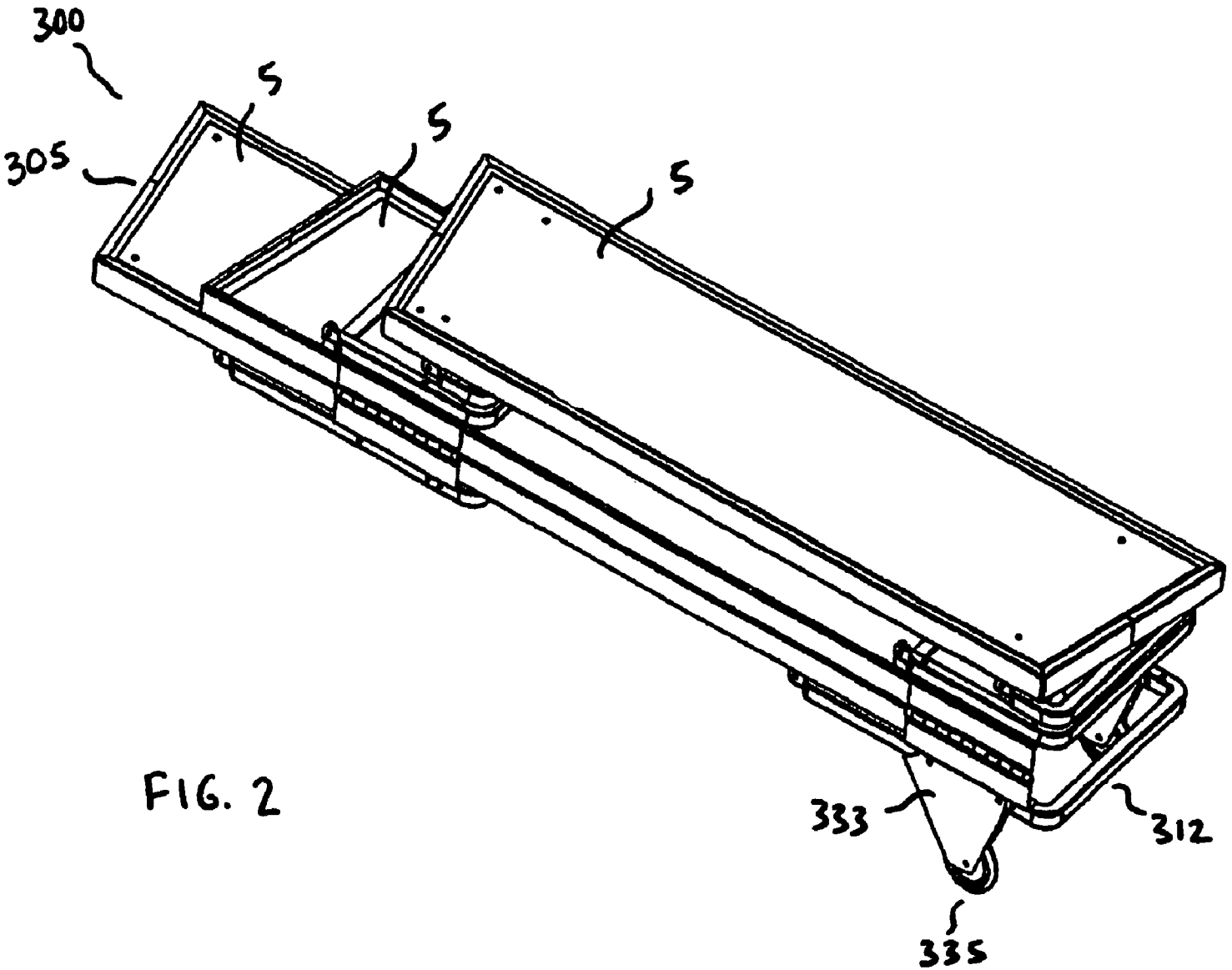
FIG. 2 illustrates an isometric view of the portable riser of FIGS. 1A-1E in a collapsed and folded configuration according to an embodiment of the present invention.
Figure 3:
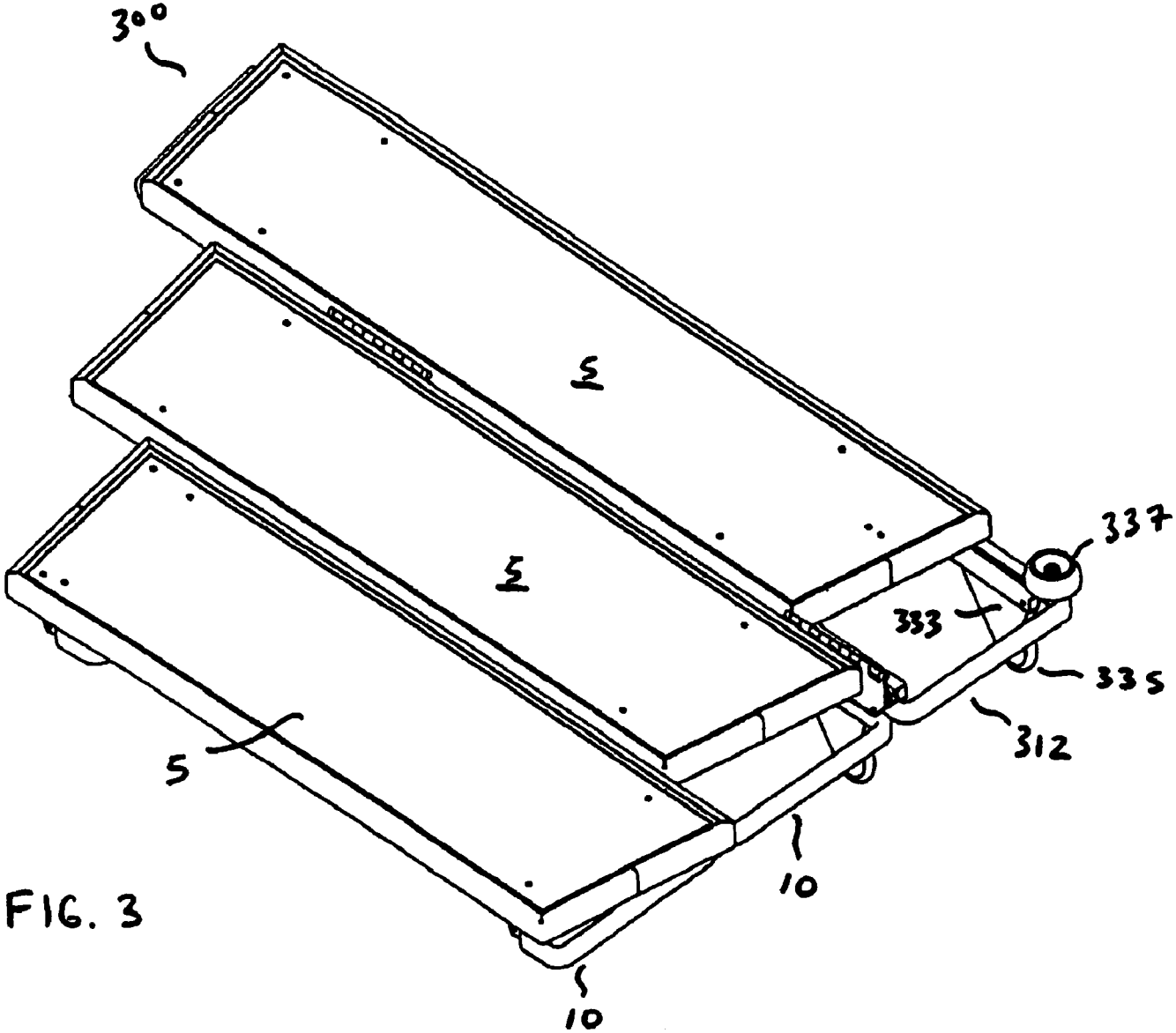
FIG. 3 illustrates an isometric view of the portable riser of FIGS. 1A-1E in a collapsed configuration according to an embodiment of the present invention.

There is provided a portable riser 100 comprising an improved lifting assist and locking assembly, shown in FIGS. 1A-1E, that provides an enhanced ability for an operator to quickly transport a folded and collapsed riser, shown in FIGS. 2 and 3, and to quickly, easily and safely set-up and take down the portable riser 100 with minimal operator applied force. Further, the lifting assist and locking assembly can maintain the portable riser 100 in an upright use position or dampen the collapse of the portable riser 100 in the event of a locking mechanism failure.

FIGS. 1A, 1B and 1C show isometric, side and rear views of the portable riser 100 according to one embodiment of the present invention. FIGS. 1D and 1E show rear isometric views of the portable riser of FIGS. 1A-1C. In one embodiment, the portable riser 100 comprises a tubular space frame and a plurality of levels of trapezoidal planar decks 5 that form a series of steps or supporting platforms, a lifting assist assembly 50, 330 and 340 and an associated locking mechanism 70 shown in FIGS. 4A-4H and 5A-5F. The lifting assist assembly preferably comprises a telescoping cross brace 50 and cooperating pivot mechanisms 330 and 340 shown in FIGS. 5A-5D.

The portable riser 100 of FIGS. 1A-1E comprises a first, second and third deck or level 5. Those of ordinary skill in the art will recognize that more or fewer decks could be used for the portable riser and that additional decks could be part of a unitary portable riser or a separate auxiliary attachment that would be fastened to the main portable riser structure 100, for example as shown in FIGS. 8-11. The general make up and configuration of the deck sections or cells 5 is well known to those of ordinary skill in the art, as shown in U.S. Pat. No. 5,381,873.

The portable riser 100 preferably comprises one or more decks 5 which are generally horizontal to the floor and parallel to each other. Each riser section or cell comprises a deck or level 5 supported by a support frame 7 that contains pivot points for the attachment of a pair of U-shaped legs 10A and 10B. The support legs 10A and 10B preferably have the same horizontal portion and bend radii. The horizontal base portion of the support legs 10A and 10B is intended to contact the floor while the vertical portions 12 of the support legs 10A and 10B vary in length according to the height of the planar deck 5 in the progression of steps in the portable riser. The U-shaped legs 10A and 10B are perpendicular to the deck 5 when the portable riser 100 is upright as shown in FIGS. 1A-1E. When the portable riser is collapsed, the support legs 10A and 10B rotate with respect to the deck 5 and are substantially parallel with the underside of the deck 5 as shown FIGS. 2 and 3.

The individual riser sections or cells are connected to form the portable riser 100 with the desired number of decks 5. In the embodiment shown in FIGS. 1A-1E, the portable riser 100 has three sections with decks 5 of varying height, though more or fewer sections can be used. Each riser section is connected to an adjacent section by a pair of hinges 13 and 15. The leaves of the hinges 13 and 15 are fixed to support legs 10A and 10B so that the support legs are allowed to move in tandem and substantially along the same plane underneath the levels or steps 5. The axis of each hinge pin is aligned with the support leg 10A and 10B to allow each riser deck 5 to be folded on top of one another for convenient transport and storage of the portable riser as shown in FIGS. 2 and 3.

In one embodiment, the lifting assist assembly comprises a telescoping cross brace 50, cooperating pivot mechanisms 330 and 340, and a locking mechanism 70 interconnected to the third deck section 300 of the portable riser, as shown in FIGS. 1A-1E, 3 and 5A-5F. Those of ordinary skill in the art will readily recognize that the lifting assist assembly and the locking mechanism 70 can instead have been interconnected to the other riser deck sections 5. The support legs 310 and 320 of the third deck 300 cooperate with the lifting assist assembly and locking mechanism 70 to mechanically assist an operator during set-up of the portable riser 100 from a collapsed position to an upright and locked use position.

As shown in FIGS. 1A-1E, 5A and 5B, the lifting assist assembly preferably comprises a substantially straight, transverse telescoping cross brace 50 and a pair of cooperating first and second pivot mechanisms 330 and 340 connected to the U-shaped legs 310 and 320 of the portable riser 100. The telescoping cross brace 50 is preferably positioned below the third deck section 300 and diagonally spans the frame support legs 310 and 320. The telescoping cross brace 50 is pinned or connected on one end 307 to the deck support frame 7 and the other end 325 to a straight crossbar 322 of an opposite or distal support leg 320 as shown in FIGS. 1A-1E and 5F. This connection configuration enables the telescoping brace 50 to actuate and pivot as the support frame legs 310 and 320 rotate to fold or unfold the portable riser 100.

Figures 4A, 4B, 4C:
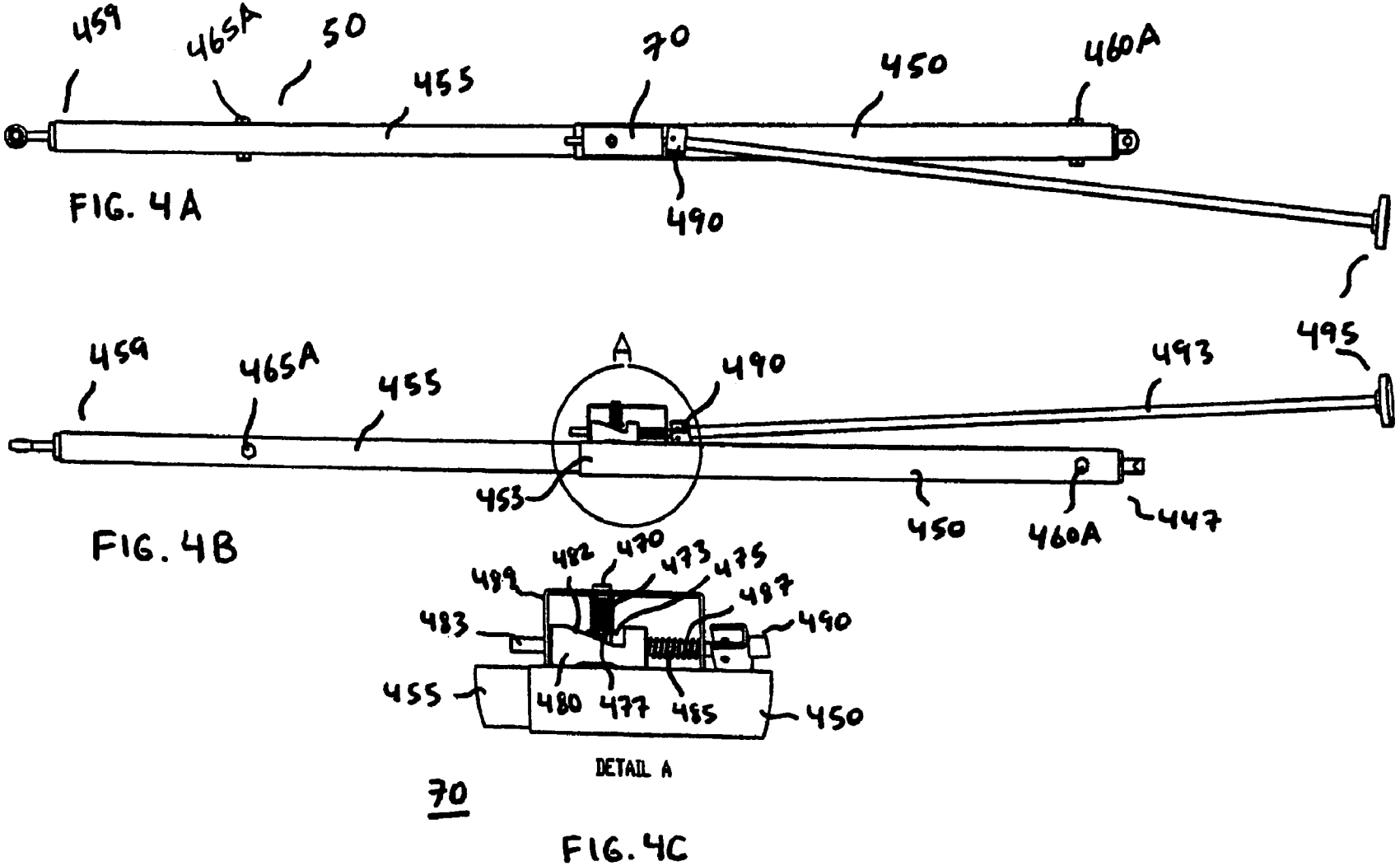
FIGS. 4A-4B illustrate a top and front view of the lifting assist assembly and locking mechanism of the portable riser shown in FIGS. 1A-1E according to an embodiment of the present invention.
FIG. 4C illustrates Detail A of the locking mechanism of FIGS. 4A-4B.
Figure 4E:
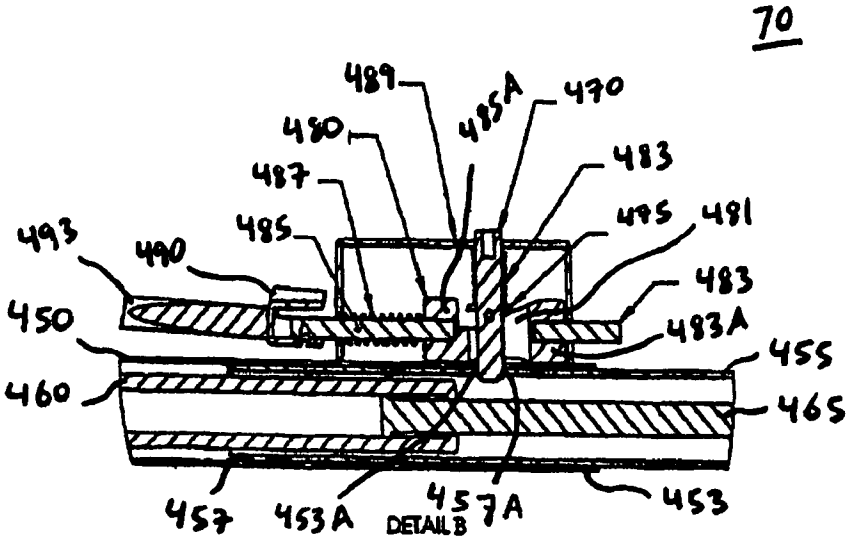
FIG. 4E illustrates Detail B of the sectioned locking mechanism of FIG. 4D in a locked position.
Figure 4D:
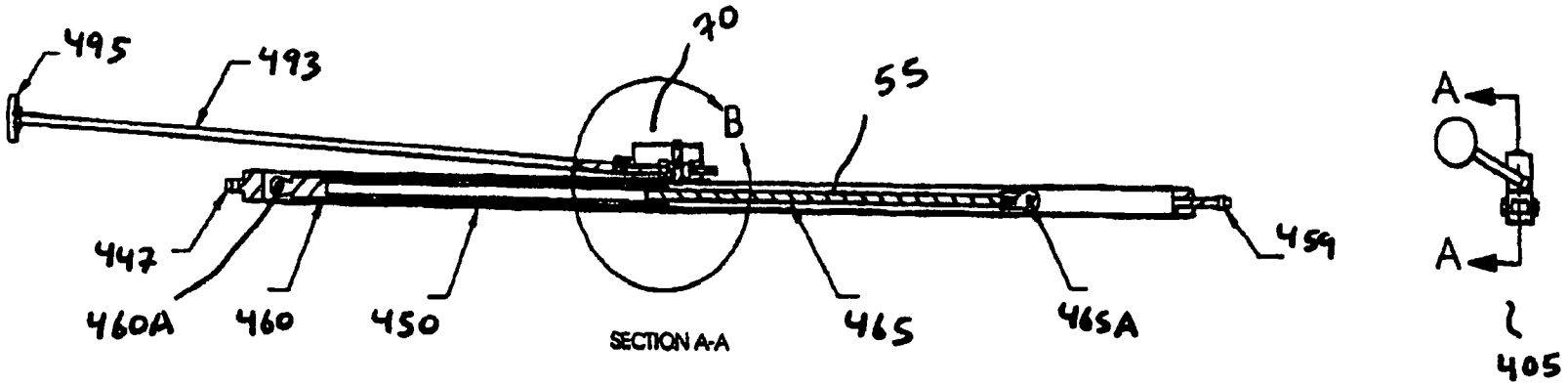
FIG. 4D illustrates a side view and section view along the line A-A of the lifting assist assembly and locking mechanism of FIG. 4B.

FIGS. 4A, 4B, 4D and 4F show top, front and front section views of the telescoping cross brace 50 which preferably comprises an outer and inner tube or sheath section 450 and 455 in a telescoping relationship relative to each other. The inner sheath 455 has a smaller cross section than the outer sheath 450 such that it can fit inside the outer sheath 450. The inner tube or sheath section 455 is thus able to travel inside the outer tube section 450 and thereby extend or contract the overall length of the telescoping cross brace 50. FIGS. 4D and 4H illustrate that in one embodiment, the outer and inner tube or sheath section 450 and 455 can have a cross-sectional shape that is substantially square or rectangular. This substantially square or rectangular cross-section of the outer and inner tubes 450 and 455 also serves to prevent rotational movement of the inner and outer tubes 455 and 450 relative to each other thereby maintaining a fixed aligned relationship between the inner and outer tubes 455 and 450 during movement of the portable riser 100. In this manner, the inner telescoping tube 455 will only travel into and out of the outer telescoping tube 450, but not rotate from side to side inside the outer telescoping tube 450. Those of skill in the art will readily recognize that the shape or configuration of the outer and inner telescoping tubes 450 and 455 can be circular, elliptical, quadrilateral, parallelogram, polygonal or other shapes that permit telescopic movement of the outer and inner tubes sections 450 and 455 and that can cooperate with the locking mechanism 70.

Figure 5B:
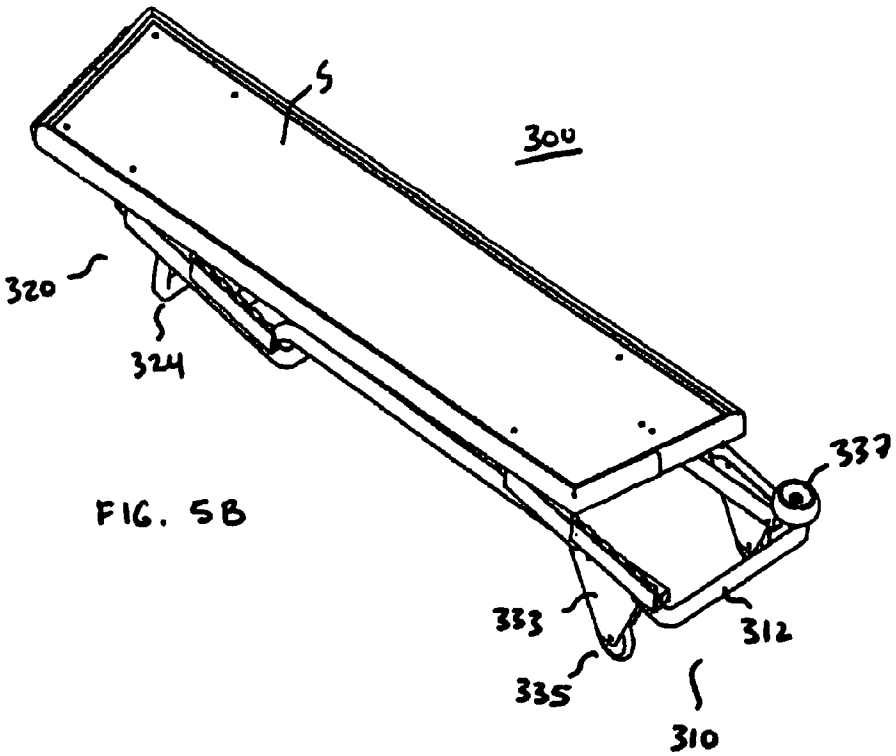
FIGS. 5A and 5B illustrate an isometric and a side view of a single riser section of the portable riser of FIGS. 1A-1E in the collapsed position.
Figure 5A:
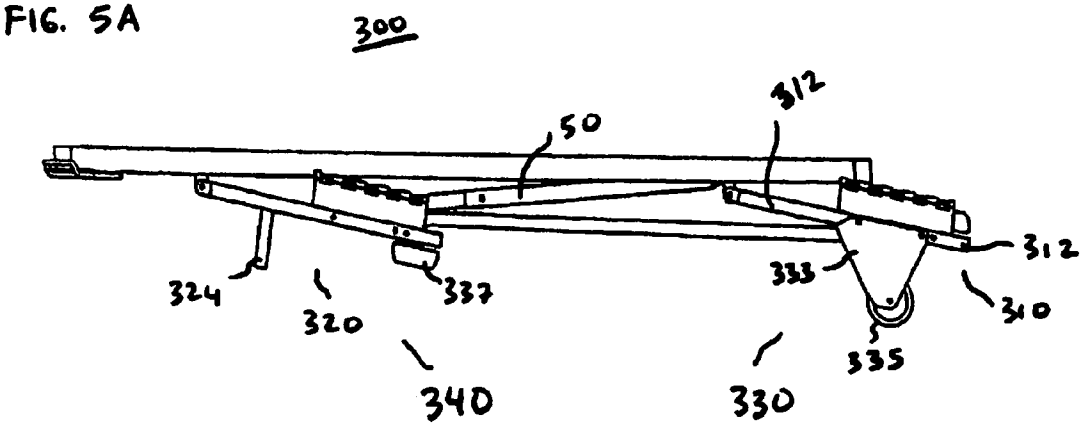

The outer sheath 450 comprises an open end 453 and a closed end 447. The inner sheath 455 comprises an open end 457 and a closed end 459 and is preferably the extending portion of the telescoping cross brace 50. The outer sheath open end 453 allows the extending portion 455 of the telescoping mechanism 50 to travel or slide therein. The outer sheath closed end 447 is preferably attached or pinned at one end 307 to the support frame 7 of the highest level, which in this embodiment is the third deck section 300 as shown in FIGS. 1A-1E and 5F. The inner sheath closed end 459 is preferably attached or pinned 325 to an opposing distal cross member 322 of the support leg 320 of the third deck section 300 located above the leg base 318 as shown in FIGS. 1D-1E and 5F The extending portion or inner sheath 455 can also be coupled or attached to the horizontal leg base 318. Those of ordinary skill in the art will readily recognize that the extending portion 455 can be pinned to other points on the support leg 320 or other points on the portable riser frame that allows the telescoping cross brace 50 to travel and pivot as the support legs 310 and 320 rotate to fold or unfold the portable riser 100.

Figure 4G:
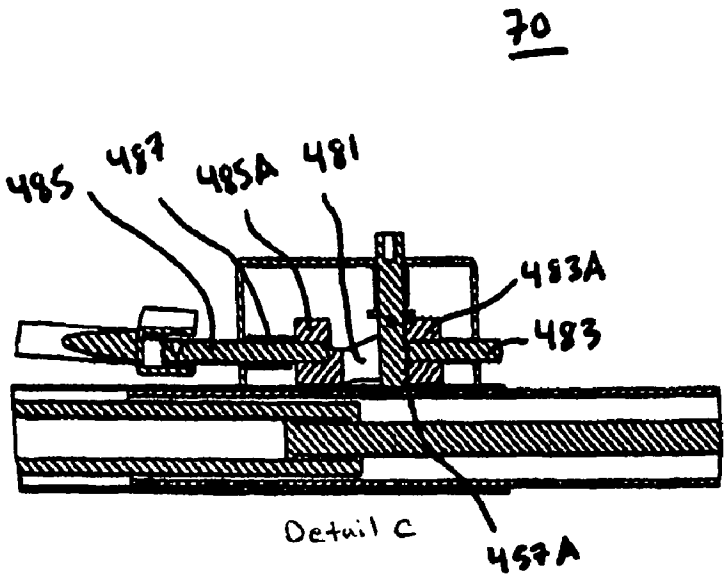
FIG. 4G illustrates Detail C of the sectioned locking mechanism of FIG. 4F in an unlocked position.
Figure 4F:
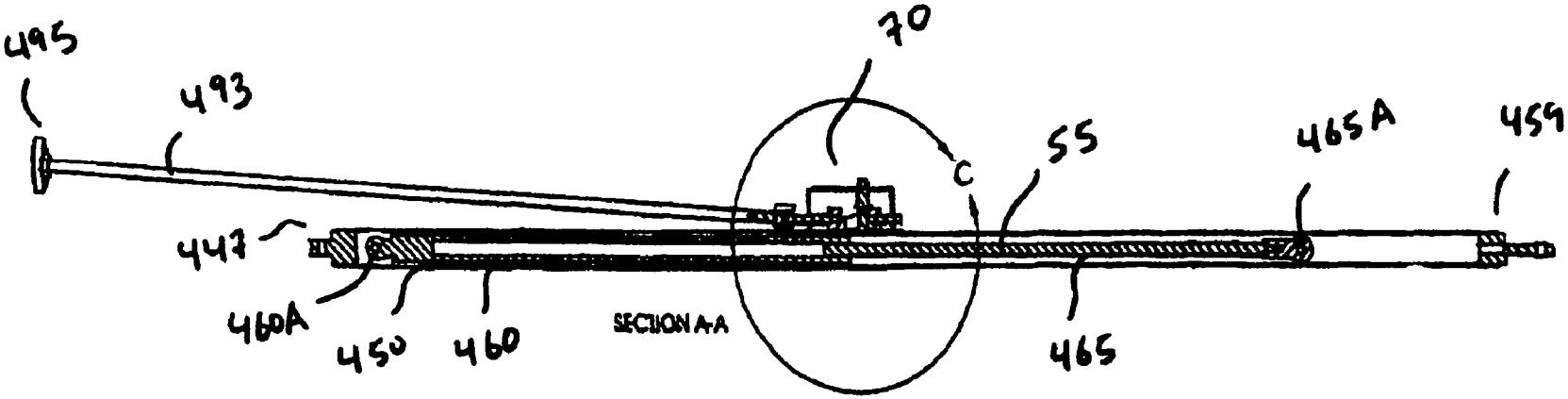
FIG. 4F illustrates the side section view of the lifting assist assembly and locking mechanism of FIG. 4D in an unlocked position.
Figure 4H:
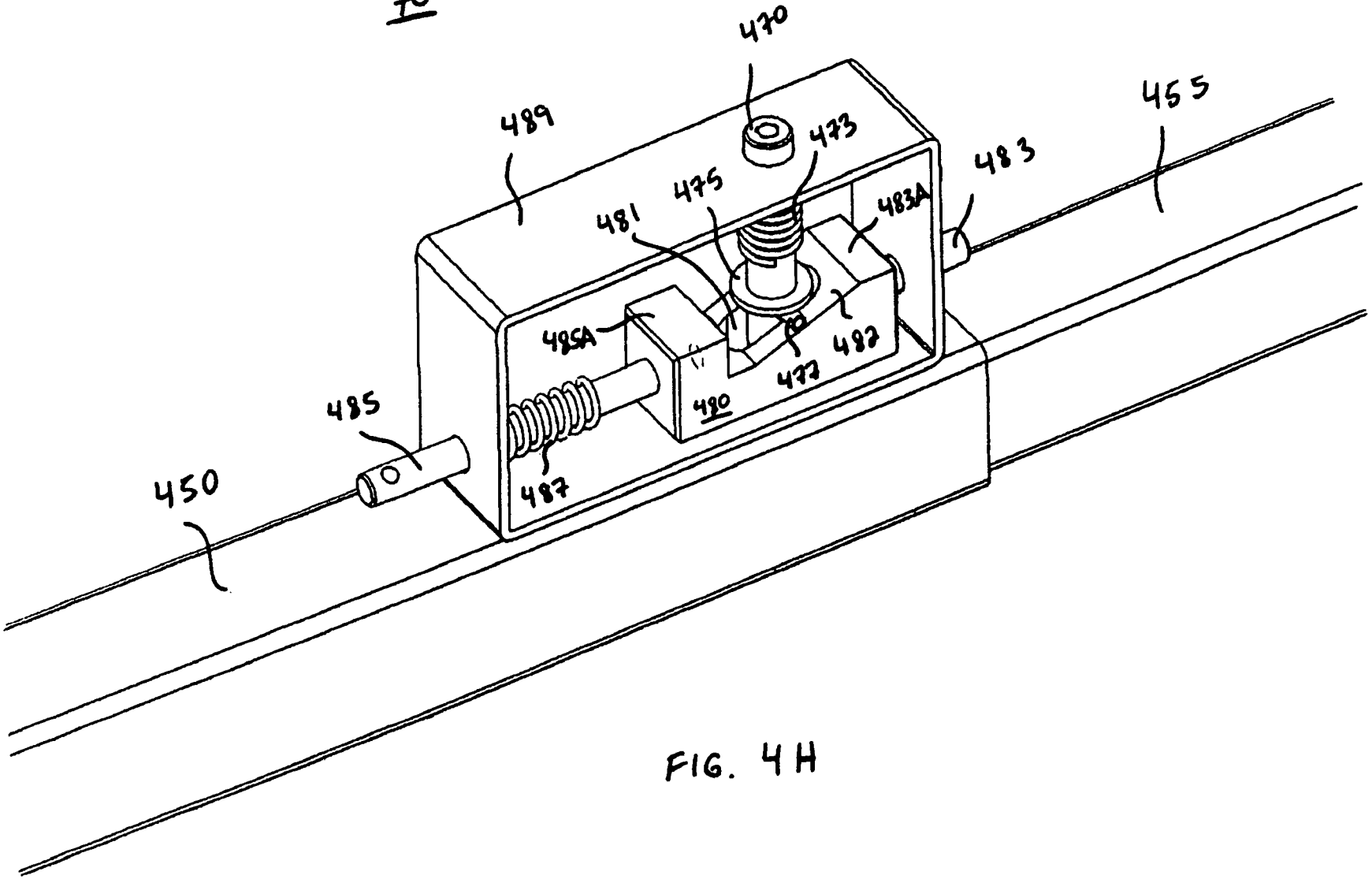
FIG. 4H illustrates an isometric view of the locking mechanism of FIGS. 4A-4G according to another embodiment of the present invention.

As shown in FIGS. 4E and 4G, the outer and inner sheaths 450 each comprise a plunger slot, aperture or opening 453A and 457A near the open end area 453 and 457 of the outer and inner sheaths 450. The plunger slots 453A and 457A accept a locking plunger 470 and operatively align or coincide when the telescoping cross brace 50 has extended sufficiently when the portable riser 100 is in an upright position. The aligned plunger slots 453A and 457A will then allow or permit the locking plunger 470 to insert or snap into the aligned plunger slots 453A and 457A. The inserted locking plunger 470 will prevent further movement or travel of the telescoping cross-brace 50 thus locking the upright portable riser 100 in a locked use position as shown in FIGS. 1A-1E, 4D-4E and 5E-5F.

As shown in FIGS. 4D-4G, the telescoping brace 50 further comprises a gas assist cylinder 55 cooperatively positioned inside the telescoping cross brace 50. The gas assist cylinder 55 comprises a fixed cylinder side 460 and an extending piston side 465. The gas assist cylinder 55 is preferably a sealed, nitrogen-charged, single piston cylinder with attachment points 460A and 465A at both the fixed stationary cylinder side 460 and the extending piston side 465. An extending piston rod end 465A or other attachment means couples the extending piston 465 of the gas cylinder 55 to the inner sheath 455 tube of the telescoping brace 50 as shown in FIGS. 4A-4B. The fixed cylinder end 460A couples the fixed side 460 of the gas cylinder 55 to the larger cross section outer sheath 455 using similar attachment means, also shown in FIGS. 4A-4B. Once operatively positioned inside the telescoping cross-brace 50, the centerline of the gas cylinder 55 centerline is preferably coincident or aligned with the centerline of the telescoping cross-brace 50. Further, in a preferred embodiment, the gas assist cylinder provides between fifty-five (55) and sixty-five (65) pounds of extension force. However, the gas assist cylinder may be selected to provide a different range of extension force depending on the total weight of the materials comprising the portable riser in a particular use application. Further, the gas assist cylinder 55 is preferably a typical gas cylinder, however those of ordinary skill in the art will readily recognize that other lifting assist means may be employed. For example, gas cylinders with other compressible gasses or means, such as a compression spring or other stored energy device, may be substituted for the nitrogen gas cylinder 55, as well as gas cylinders having other extension force quantities.

In the upright and locked position, shown in FIGS. 1A-1E and 5E-5F, the telescoping brace 50 and the gas assist cylinder 55 are extended. When the portable riser 100 is brought down or collapsed from the upright position, the telescoping brace 50 and the overall length of the gas assist cylinder 55 is shortened. During break down of the portable riser 100, the gas assist cylinder 55 is shortened and compressed and thereby builds up and stores energy which will be used to assist the operator during set-up of the portable riser 100. The gas assist cylinder 55 preferably partially extends after it reaches its fully compressed position shown in FIGS. 3, 5A and 5B. In this manner, gas assist cylinder 55 reaches its minimum length, i.e., the length at which maximum potential energy is stored in the gas cylinder, before the portable riser is fully collapsed. Thus, by the time the unit is fully collapsed, the gas assist cylinder 55 will have reached its minimum length and then partially extended. The gas assist cylinder thereby holds the portable riser leg 10, 310, and 320 assemblies in the collapsed position with a small amount of extending force since it is partially extended.

During the set-up of the portable riser, the gas assist cylinder 55 transforms the stored energy in the compressed gas to provide a lifting force sufficient to propel the portable riser 100 from a partially collapsed position to an upright and locked use position. In this manner, the gas assist cylinder 55 assists the operator to lift the portable riser 100 during the set up of the portable riser 100. In the event that the gas assist cylinder 55 does not propel the portable riser 100 into a fully upright position, the operator need only apply a small or minimal amount of manual lifting force to the riser deck 5 to augment the lifting force provide by the gas assist cylinder 55 in order to fully raise the portable riser 100 into the upright and locked use position.

The gas assist cylinder 55 also serves as a back-up or secondary safety device to the portable riser's locking mechanism 70, discussed below. The gas assist cylinder 55 can maintain the portable riser in an upright and stable position and prevent the sudden collapse of the portable riser in the event of an unintended disengagement or failure of the locking mechanism 70. The gas assist cylinder 55 provides a constant opening force that tends to extend the telescoping brace. Thus, the gas assist cylinder 55 will extend the telescoping brace 50 and thereby maintain or bring the portable riser back into an upright position until the locking mechanism 70 re-engages in a locked position. If the locking mechanism 70, has completely failed, the gas assist cylinder 55 prevents the sudden and unexpected collapse or free fall of the portable riser 100 by providing a sufficient opening or extending force to keep the portable riser 100 upright. As described above, in one embodiment, the gas assist cylinder 55 provides between fifty-five (55) and sixty-five (65) pounds of extension force. If the extending or opening force provided by the gas assist cylinder 55 is insufficient due to excessive load on the portable riser 100, the gas assist cylinder 55 will nonetheless provide a damping force to slow or retard the collapse of the portable riser 100.

FIGS. 1A-1E and 4A-4H further show the telescoping cross brace 50 operatively coupled to a locking mechanism 70. The outer sheath 450 preferably serves as a base for the locking mechanism 70. The locking mechanism 70 can be fastened to the outer sheath or tube 450 via fastening means known to those of ordinary skill in the art. For example, by welding a locking mechanism housing 489 to the outer telescoping tube 450. The locking mechanism 70 comprises a locking plunger or detent pin 470, a plunger compression spring 473, a plunger spring retaining washer 475, a plunger roll pin 477, an inclined plane member 480 with an exterior inclined surface 482, an inclined plane guide pin 483, a locking mechanism actuator pin 485, an actuator guide spring 487 and a locking mechanism housing 489. In one embodiment, the locking mechanism housing 489 has a substantially rectangular cross-section, as shown in FIG. 4H. The locking mechanism housing 489 can be cut from standard steel tubing known to those of ordinary skill in the art. The locking mechanism housing 489 can have other configurations that can be used with the locking mechanism 70 and telescoping tubes 450 and 455, including housings having a cross-sectional shape of a square, quadrilateral, parallelogram, polygon, circle or ellipse or other known configurations that will accomplish the same function of the locking mechanism housing 489.

The locking plunger 470 is the primary means of locking the telescoping cross brace 50, and thereby the portable riser 100 mechanism, when in the upright use position shown in FIGS. 1A-1E, 4E and 5E-5F. The locking plunger 470 comprises a hole or aperture drilled perpendicular to the locking plunger's 470 longitudinal axis and generally in the midsection of the locking plunger 470, as shown in FIGS. 4E, 4G and 4H. A plunger roll pin 477 is inserted into the locking plunger hole to secure a spring retaining washer 475 which retains one end of a plunger compression spring 473 which acts along the axis of the locking plunger 470. The other end of the plunger compression spring 473 is retained by the inner wall of the locking mechanism housing 489. The locking mechanism housing 489 further comprises a hole placed along the axis of the locking plunger 470 to enable the locking plunger 470 to travel through the wall of the locking mechanism housing 489 as the locking plunger 470 is actuated by the plunger compression spring 473 and inclined plane member 480. The spring-loaded locking plunger 470 thus is spring biased toward the telescoping cross brace 50 and towards the locking position.

The locking plunger 470 is configured to snap into or be forced-into the locking position when the inner and outer sheath plunger slots 453A and 457A operatively align when the portable riser 100 is in the fully erect or upright position. The aligned plunger slots 453A and 457A create a void, aperture or orifice that allows the spring-loaded locking plunger 470 to snap or insert into the aligned plunger slots 453A and 457A. In the inserted position, the locking plunger 470 prevents further travel or movement of the telescoping brace 50 thus locking the telescoping cross brace 50, which thereby locks the portable riser 100 in an upright use position as shown in FIGS. 1A-1E, 4E and 5E-5F.

As shown in FIGS. 4C, 4E, 4G and 4H, the inclined plane member 480 preferably comprises an inclined surface 482 that interacts with the plunger roll pin 477 and locking plunger 470. The plunger roll pin 477 and the locking plunger 470 slide or travel along the inclined surface 482 when the locking plunger 470 snaps into a locking position upon the alignment of the sheath plunger slots 453A and 457A when the portable riser 100 reaches the upright position or when the locking mechanism 70 is actuated and unlocked by an operator to collapse the portable riser 100 from the upright locked position. The inclined plane member 480 also comprises an inclined plane plunger slot 481 that traverses the midsection of the inclined plane member 480. The inclined plane plunger slot 481 enables the locking plunger 470 to pass through the inclined plane member 480 as the locking plunger 470 is actuated into and out of a locking position. The inclined plane plunger slot 481 preferably has a width that is wider than the diameter of the locking plunger 470 and is longer than or equal to the amount of travel allowed by the actuator guide spring 487 and inclined plane surface 482. In one embodiment, the inclined plane member 480 comprises a configuration as shown in FIG. 4H where the inclined plane member 480 has a cross-section in the shape of a square or rectangle. Those of ordinary skill in the art will readily recognize that the inclined member can have other shapes, including a quadrilateral, parallelogram, polygon, circle or ellipse or other known configurations that will accomplish the same function of the inclined plane member 480.

In one embodiment, the inclined plane member 480 also comprises two drilled and tapped holes or slots 483A and 485A perpendicular to the longitudinal axis of the locking plunger 470 as shown in FIGS. 4E, 4G and 4H. Those of ordinary skill in the art will readily recognize that though the two holes 483A and 485A are preferably tapped, it is not a necessity that both holes be tapped. One or both slots 483A and 485A could be threaded to ease assembly or instead use other known fastening means to securely fasten the locking mechanism actuator pin 845 and inclined plane guide pin 483. The first tapped hole 483A is preferably nearest the higher point of the inclined plane and fastens the inclined plane member 480 to an inclined plane guide pin 483 which maintains the inclined plane member 480 aligned along its line of travel. The second tapped hole 485A fastens the inclined plane member 480 to a locking mechanism actuator pin 485.

FIGS. 4A, 4B, 4D and 4F show that the locking mechanism actuator pin 485 is configured to transmit the operator's hand motion, at knob 495 and handle rod 493, to the inclined plane member 480. The locking mechanism actuator pin 485 is threaded at one end 485A, where it fastens to the inclined plane member 480, and a hole is drilled at its other end perpendicular to the longitudinal axis of the locking mechanism actuator pin 485. The perpendicular hole allows a cotter pin to connect the locking mechanism actuator pin 485 to the knob linkage 495 via a clevis connector 490. Further, a compression actuator guide spring 487 is placed along the axis of the locking mechanism actuator pin 485. One end of the guide spring is retained by one wall of the inclined plane member 480 and the other end of the actuator guide spring 487 is retained by the inside wall of the locking mechanism housing 489, where a hole has been drilled to allow the actuator pin to pass through.

When the portable riser 100 is in the upright locked position, it can be collapsed by an operator by actuating a spring-loaded unlocking handle, knob linkage or other unlocking means 495 that mechanically connects to the locked locking mechanism 70 shown in FIGS. 1C-1E and 4A-4G. The unlocking knob linkage 495 is connected to a linkage rod member 493, which is in turn connected to the locking mechanism actuator pin 485 by way of a clevis 490 welded to the end of the linkage member 493, which is coupled to the locking mechanism actuator pin 485. Those of ordinary skill in the art will readily recognize that the linkage member 493 could be connected to the locking mechanism actuator pin 485 through other known connecting means other than a welded clevis 490.

The unlocking knob linkage 495 is preferably retained and positioned at an easily accessed grab point near the edge of the largest or highest deck 300 by a bracket and pivot or other suitable positioning means 497 as shown in FIGS. 1C-1E. In one embodiment, positioning means 497 for the unlocking knob linkage 495 is a bracket that is constructed of sheet metal and is fastened to the underside of the third deck 300 by two fasteners, while the pivot is captured at both ends by the bracket and contains a through hole which allows the knob linkage 495 to pass through as the operator actuates the knob 495.

FIGS. 1C-1E and 5A-5F further show that the lifting assist assembly further comprises a pivot mechanism having a first and second lifting assist pivot mechanism 330 and 340. The first lifting assist pivot mechanism 330 comprises a set of wheeled caster brackets 333 that act as a pivoting device when the portable riser 100 is being set-up and a means for transporting the portable riser when the portable riser is in a completely folded position as in FIGS. 2 and 3. The pivot bracket wheels 335 are located and mounted above the horizontal portion or base 312 of the support leg 310 so that when the portable riser 100 is upright in the use position, the bracket wheels 335 are not in contact with the floor as shown in FIGS.

1A-1E. Further, the wheeled caster brackets 333 are mounted in a configuration such that the pivot bracket wheels 335 act as a fulcrum in conjunction with the horizontal leg portion or base 312 of the leg 310. Thus, as the operator steps on the base 312 of the leg 310, in order to set-up the portable riser from a collapsed position, the wheeled caster brackets 333 and pivot bracket wheels 335 pivot the leg 310 towards an upright position. In one embodiment, the wheeled caster brackets 333 can have a configuration that substantially resembles an equilateral triangle, as shown in FIGS. 1C-1E, 5A-5B and 5D. In another embodiment, the wheeled caster brackets 333 can have a configuration that substantially resembles a right triangle as show in FIGS. 5E-5F. Those of ordinary skill in the art will readily recognize that other configurations may be employed for the wheeled caster brackets 333 to serve as a pivoting means or device in the first lifting assist pivot mechanism 330 when the portable riser 100 is being set-up and/or as a means for transporting the portable riser 100 when the portable riser is in a completely folded position as in FIGS. 2, 3 and 5A-5B. Such wheeled caster brackets 333 configurations can include other known triangular configurations, polygonal or other known configurations that will accomplish the same function of the locking mechanism housing 489.

FIGS. 1C, 5B and 5C-5F also show a pair of riser positioning wheels 337 that are preferably mounted or placed perpendicular to the axis of rotation of the pivot bracket wheels 335. A positioning wheel 337 is preferably located on each of the third level legs 310 and 320. The positioning wheels 337 are cantilevered off the leg frame and are positioned close to the leg base so that when the portable riser 100 is fully upright in the use position, the positioning wheels 337 do not contact the floor. The cantilevered positioning wheels 337 preferably provide a means to move and position the portable riser 100 once it has been fully set-up. In the upright and locked position, the operator can grasp the lowest or first level and lift the portable riser 100 upward. As the operator lifts the portable riser 100, the positioning wheels 337 come in contact with the floor and the weight of the riser is thereby transferred from the base of the legs 10, 310 and 312 to the positioning wheels 337. Once the portable riser has been lifted past a weight transfer point only the positioning wheels 337 contact the floor and the raised portable riser 100 can be maneuvered and repositioned by the operator while in the upright and locked position.

FIGS. 1E, 5A, 5C-5F and 6 show that the second opposing or distal lifting assist pivot mechanism 340 comprises a support leg 320 preferably having a straight 322 and U-shaped crossbar 324 that spans the support leg 320. The straight crossbar 322 is preferably used to locate and secure the attachment point 325 for the telescoping cross brace 50. The second crossbar 324 is preferably a U-shaped crossbar that spans the vertical upright portions of the opposite leg 320 in a generally outward direction as shown in FIGS. 1E, 5E-5F and 6.

In a function similar to that of the wheeled pivot brackets 333, the U-shaped crossbar 324 helps pivot the portable riser 100 leg assembly 10 when the operator is setting up the portable riser 100 from a collapsed position. Instead of pivoting the support leg 10 up, as is done by the wheeled pivot brackets 333, the U-shaped crossbar 324 enables the horizontal base 318 of its attached leg 320 to pivot downward as the lifting assist mechanism extends and travels to begin to raise the portable riser 100 from a collapsed position toward an upright position. The U-shaped crossbar 324 acts as a fulcrum, enabling the attached leg 320 to start the motion of setting up the portable riser 100 without having the lifting assist mechanism or the operator lift the full weight of the portable riser 100. The U-shaped crossbar 324 thereby further reduces the force required at the horizontal base 312 of the first proximal leg 310, where the operator is applying force through his/her body weight, to set-up the portable riser 100. This is the case since the position and configuration of the U-shaped crossbar 324 enables the support legs 10 and 310 on the side of the U-shaped crossbar 324 to quickly drop into a position to begin supporting the weight of the portable riser 100.

An additional feature of the U-shaped crossbar 324 is that it enables an operator to grab and hold a collapsed portable riser for ease in moving and transporting. The U-shaped crossbar 324 maintains the end of the portable riser opposite the pivot bracket wheels 335, above the ground when the unit is in a folded or collapsed position as shown in FIGS. 5A-5B and 2. An operator can thus grab and hold the collapsed portable riser from one end 305 of the deck 5, shown in FIG. 2, and maneuver the portable riser 100 as desired. In contrast, existing portable risers without the U-shaped crossbar 324 require that an operator slide his or her fingers underneath the folded and collapsed riser in order to lift the riser unit of the floor and then move or maneuver the portable riser thereby increasing the possibility of operator injury.

Portable Riser Set-Up Operation

FIG. 3 depicts the portable riser 100 in an unfolded and collapsed position prior to initiating the set-up of the portable riser 100 to an upright and locked use position, as shown in FIGS. 1A-1E and 5E-5F, by a single operator exerting minimal set-up force. In one set-up process of the portable riser 100, the single operator steps on the base 312 of the support leg 310, shown in FIGS. 5A-5B, to impart a set-up force on the leg base 312 through his body weight. This initial set-up action actuates the first lifting assist pivot mechanism 330 such that the wheeled caster brackets 333 and pivot bracket wheels 335 pivot the leg 310 towards an upright position. The force of the operator's body weight will lift the collapsed portable riser sufficiently to move and extend the lifting gas assist cylinder 55 from its collapsed position. The movement of the gas assist cylinder 55 is preferably assisted and made easier by the U-shaped crossbar 324 located on an opposite distal second leg 320 of the second lifting assist pivot mechanism 340. When the portable riser 100 has been partially raised by the operator's set-up force, which also actuates first and second pivot mechanisms 330 and 340, the lifting gas assist cylinder 55 will have moved or traveled sufficiently such that the extending force being imparted via the telescoping cross brace 50 can thereby completely take over the lifting of the portable riser 100 into an upright position.

Figure 5D:
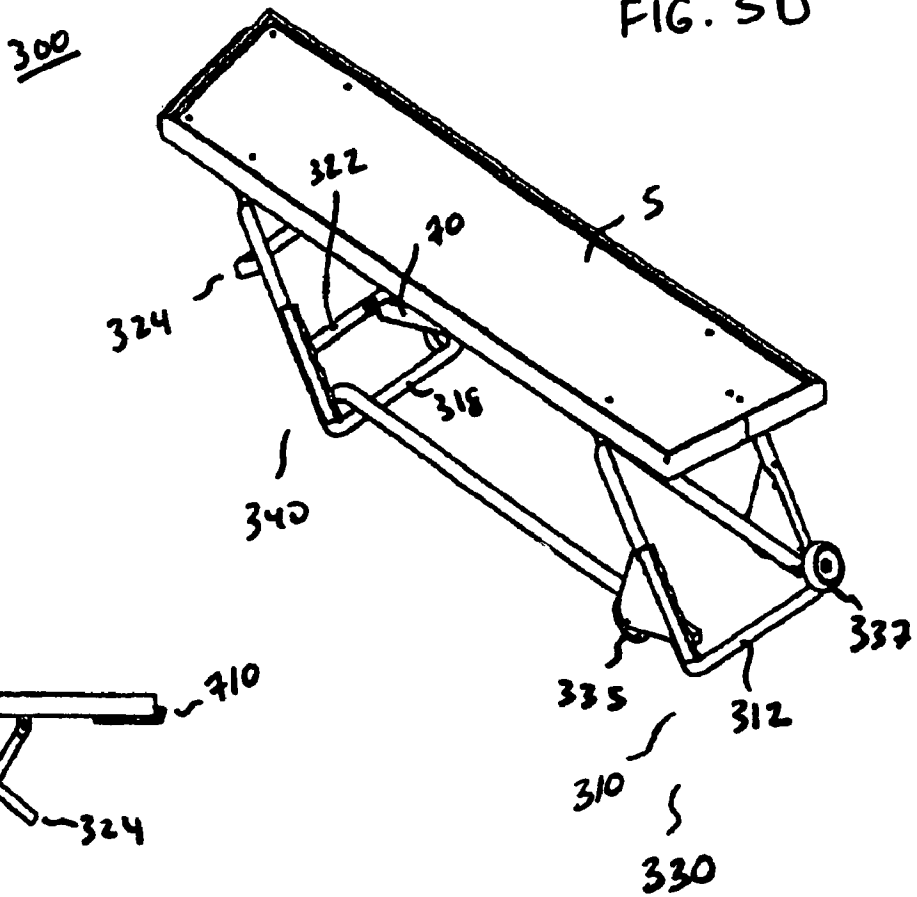
FIGS. 5C and 5D illustrate an isometric and rear view of the single riser section of FIGS. 5A and 5C in a partially set-up position.
Figure 5C:
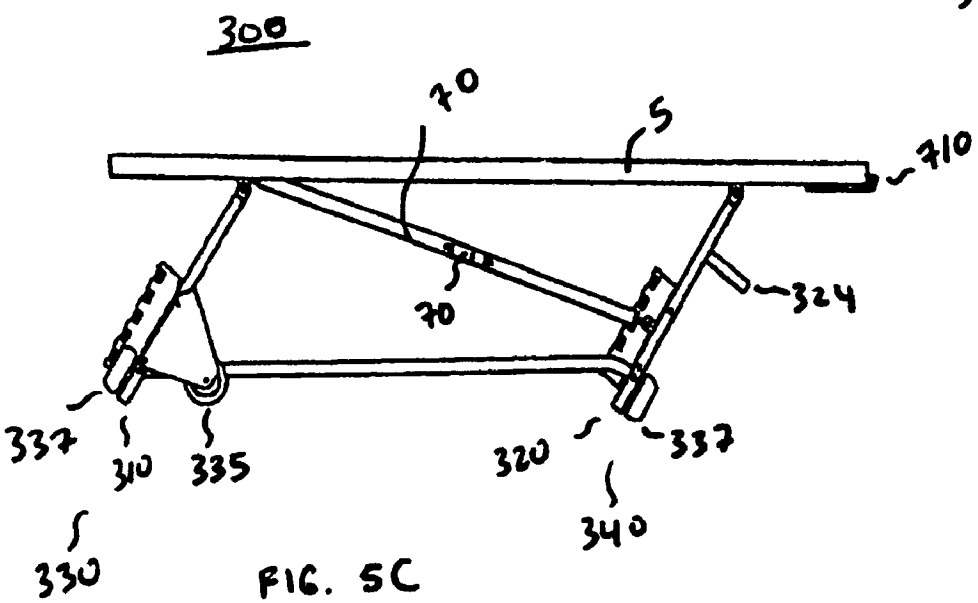

As the portable riser 100 is being lifted into the upright position by the telescoping cross brace 50 via the gas assist cylinder 55, as shown in FIGS. 5C-5D, the spring-loaded locking plunger 470 in the locking mechanism 70 remains disengaged until it is operatively aligned with the inner sheath plunger slot 457A in the inner telescoping tube 455. When the locking plunger 470 is aligned with the inner sheath plunger slot 457A, the plunger spring 483 on the locking plunger 470 forces or snaps the locking plunger 470 into the plunger slot 457A which thereby prevents any further travel of the telescoping brace tubes 450 and 455 and maintains the portable riser 100 locked in the upright use position. The inner plunger slot 457A is preferably located and configured in such a manner that when the locking plunger 470 snaps or is forced into place, the portable riser's 100 legs 10, 310 and 320 are perpendicular to the floor and the decks 5 are parallel to the floor such that the portable riser 100 is upright, stable and locked in the use position. The lifting action on the portable riser 100 is complete when the locking mechanism 70 engages and locks the portable riser 100 at the fully upright use position.

The actuating or extending force of the gas assist cylinder 55 is preferably sufficient to propel the portable riser 100 into an upright and locked use position as shown in FIGS. 1A-1E and 5E-5F. Also, the locking mechanism 70 preferably functions in cooperation with the telescoping cross brace 50, which internally comprises the gas assist cylinder 55, to lock the portable riser in the fully upright, stable and locked use position as shown in FIGS. 1A-1E and 5E-5F.

In the event that the lifting gas assist cylinder 55 does not propel the portable riser 100 into the fully upright and locked position, the single operator need only apply a small additional manual lifting force to a portable riser deck 5 in order to fully erect and lock the portable riser 100 into the upright use position.

Portable Riser Collapse/Break Down Operation

FIGS. 1A-1E and 5E-5F depict the portable riser 100 in a fully upright and locked position while FIG. 3 depicts the portable riser 100 in a collapsed position prior to folding the portable riser 100 for transport or storage. In one breakdown process of the portable riser 100, the operator temporarily positions his or her foot on the rear portion of the base 312 of the support frame leg 310 of the first pivot mechanism 330 while placing a hand on the deck 5 near the release knob 495. The operator may also allow his or her thigh to contact the edge of the deck 5, when he or she places a foot on the frame base 312. The operator may wish to transfer some body weight through the deck 5 to ease the collapse of the portable riser 100. Once the operator's hand is placed on the deck 5 near the location of the release knob 495, the operator grabs the release knob 495 underneath the deck and pulls the release knob 495.

When the release knob 495 is pulled, the knob's 495 movement or travel is translated through the linkage rod 493, the clevis 490, the actuator pin 485 and finally to the inclined plane member 480. The movement of the inclined plane member 480 moves the locking plunger 470 in an upward direction through the interaction of the inclined surface 482 and the plunger roll pin 477. The locking plunger will continue its upward movement away from the aligned sheath plunger slots 453A and 457A until the locking plunger 470 exits the plunger slot 457A of the inner sheath or inner telescoping tube 455. This action releases or unlocks the locking mechanism 470.

Once the locking mechanism 470 is unlocked, the gas assist cylinder 55 is still providing an extending force via the telescoping cross brace 50. Thus, the portable riser remains in the upright position. If, without more, the operator were to release the release knob 495, the gas assist cylinder 55 would bring the portable riser 100 back to an upright position and re-engage the locking mechanism, maintain the portable riser 100 in an upright position, or provide a damping force.

In order to continue to break down or collapse the portable riser 100, once the operator has pulled the release knob 495 and unlocked the locking mechanism 470, the operator will simultaneously push against the deck with an operator applied force that is sufficient to overcome the lifting or extending force of the lifting gas cylinder 55 while temporarily keeping his foot on the frame base 312 of the first pivot mechanism 330. Maintaining the operator's foot on the rear portion of the frame base 312 prevents the portable riser 100 from sliding away from the operator as he or she pushes against the deck 5, but may be unnecessary if sufficient surface friction is afforded by the floor. In one embodiment, the collapsing force required to be applied by the operator in order to overcome the gas assist cylinder 55 force is about forty-five (45) pounds of force pushing horizontally. Other portable risers 100, having gas assist cylinders with greater extending force would require an appropriate operator collapsing force to overcome the gas assist cylinder force.

As the operator pushes the portable riser 100 toward a collapsed position, the force of gravity gradually replaces the force needed by the operator to overcome the gas assist cylinder 55 extending force to continue the collapse of the portable riser 100 decks 5. As this occurs, the operator removes his foot from its position on the frame base 312. As the portable riser passes the position shown in FIGS. 5C and 5D, the operator has removed his foot from the frame base 312, allowing the frame base 312 to pivot upward as the portable riser collapses toward the position depicted in FIG. 3. The gas assist cylinder's 55 extending force now provides damping that slows the collapse of the portable riser 100. Once the portable riser has completely collapsed as shown in FIG. 3, the extending force of the gas assist cylinder is still present, however the extending force is now in a horizontal direction and thus cannot lift the portable riser until the first and second pivot mechanisms 330 and 340, shown in FIGS. 5A-5F, have partially lifted the portable riser legs 310 and 320 during the set process.

Once in the collapsed position, the portable riser 100 may be folded into a more compact configuration. When transforming the portable riser 100 from the collapsed configuration, shown in FIG. 3, to the fully folded configuration, shown in FIG. 2, the planar decks 5 are folded into close parallel and face-to-face relation about the two sets of hinges 13 and 15. The third riser section 300 with the attached caster brackets 333 and wheels 335 form a base while the second and first levels, respectively, fold on top of the base. From this position, the portable riser 100 may be moved easily to another location. The operator simply lifts the folded portable riser from the side opposite the transport bracket wheels 335, leaving the wheels 335 as the only part of the portable riser 100 contacting the floor which enhances maneuverability.

Figure 5E:
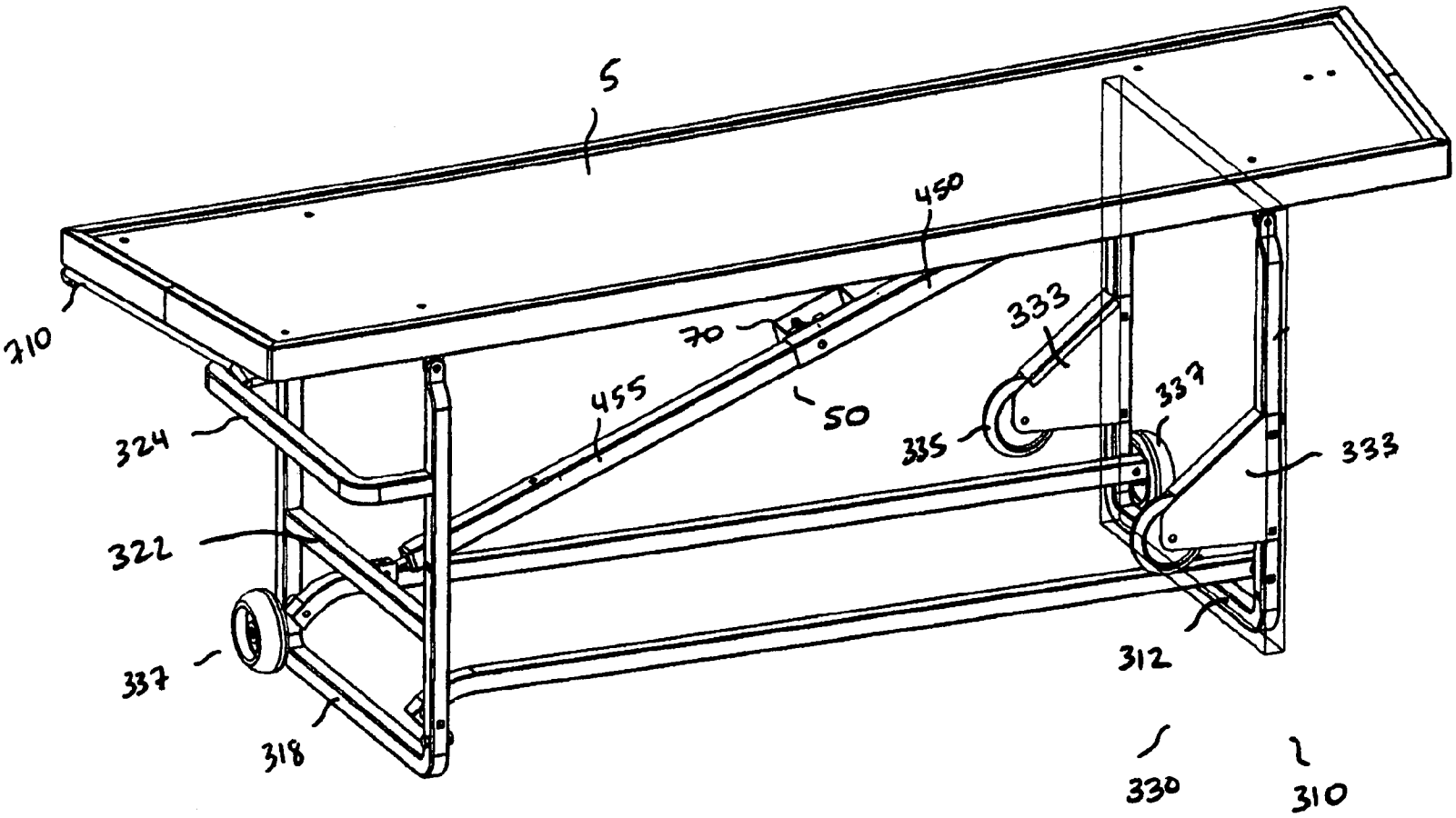
FIGS. 5E and 5F illustrate an isometric and front view of the single riser section of FIGS. 5A and 5B in an upright set-up position according to another embodiment of the present invention.
Figure 5F:
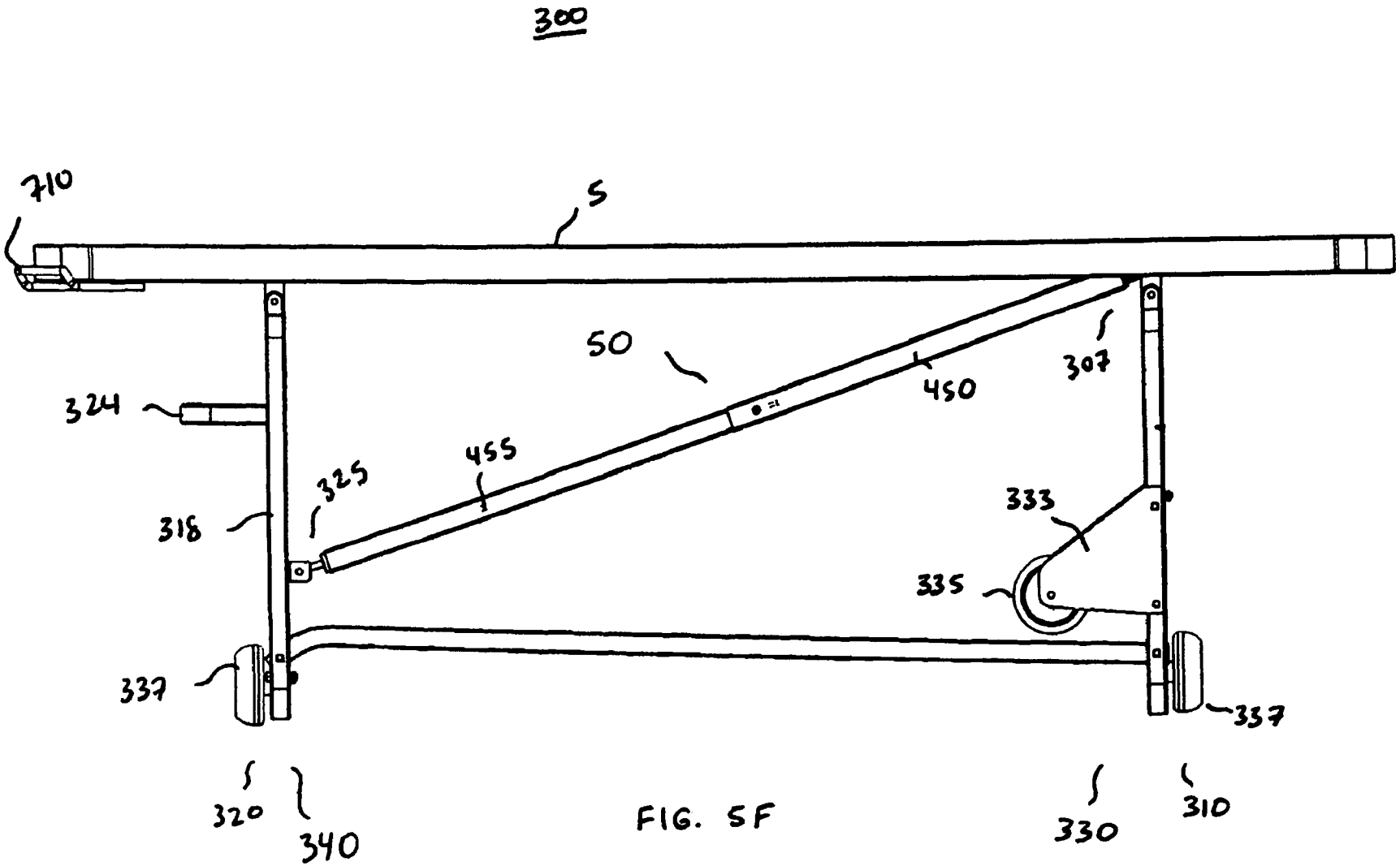
Figure 6:
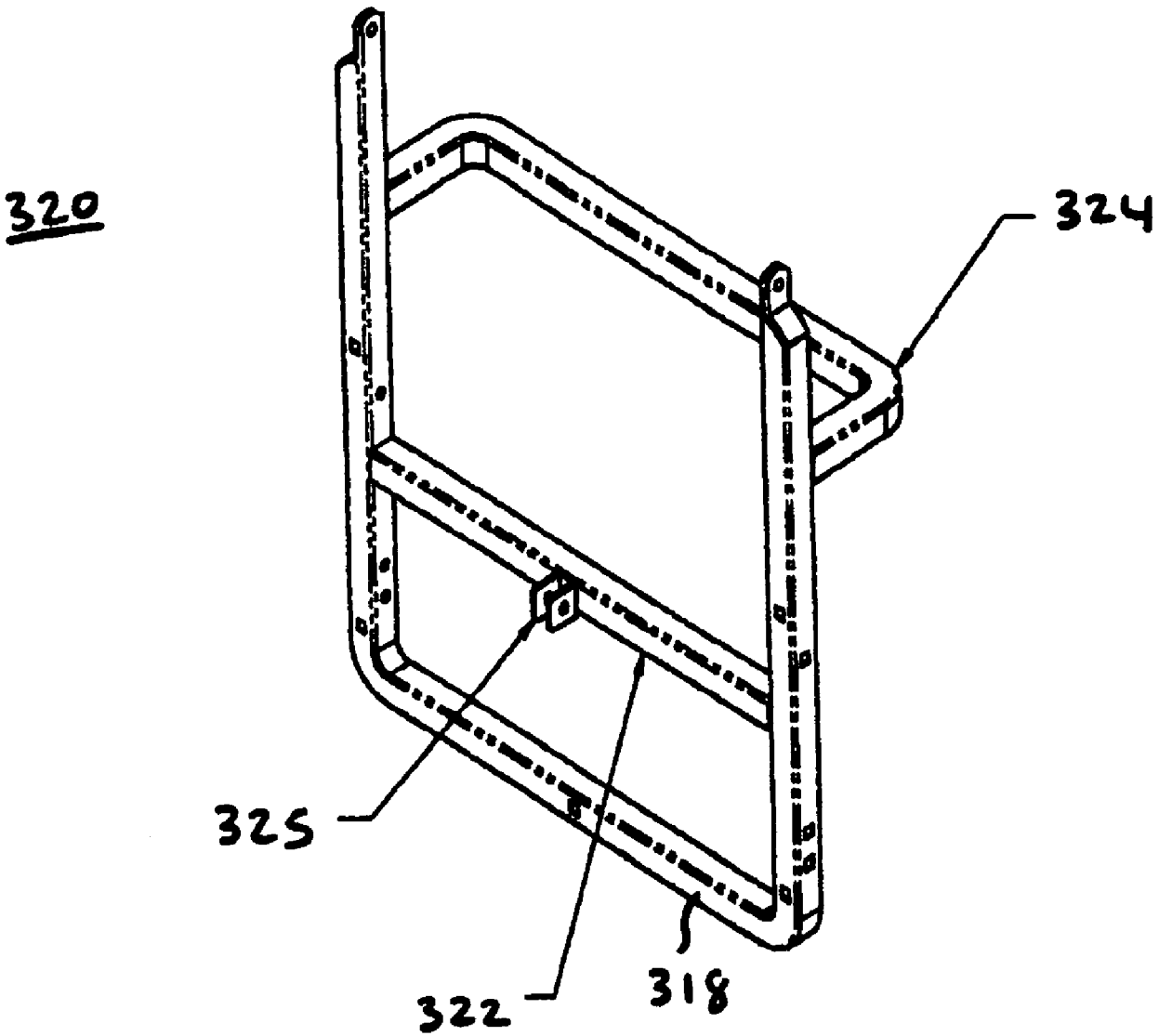
FIG. 6 illustrates an isometric view of a support leg with a straight and U-shaped cross member of the portable riser of FIGS. 1A-1E.
Figure 7C:
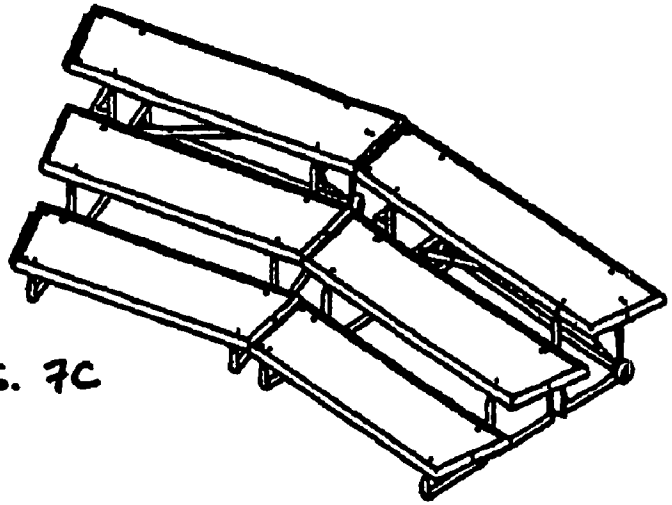
FIGS. 7A, 7B and 7C illustrate a top, underside and isometric view of two portable riser coupled according to an embodiment of the present invention.
Figure 7A:
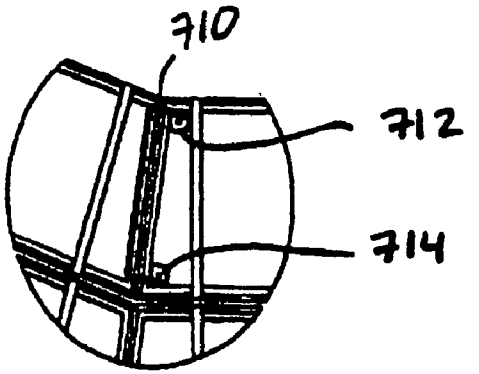
Figure 7A:
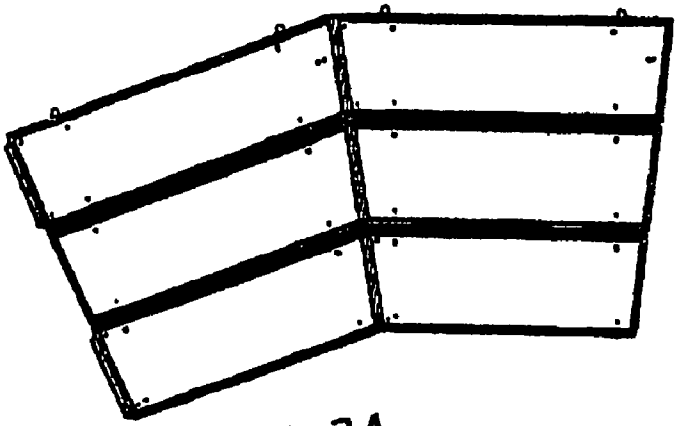
Figure 7B:
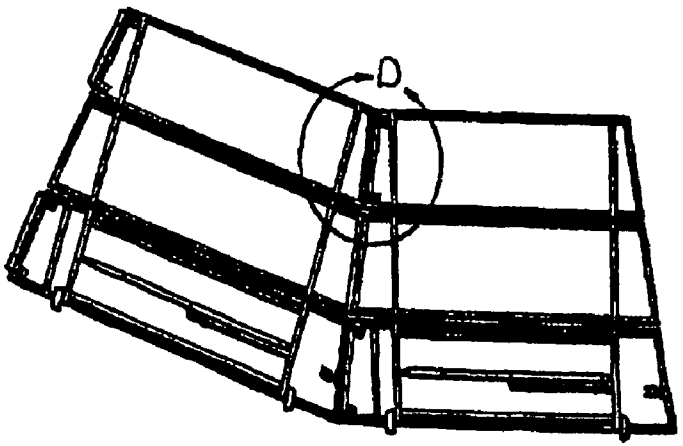

FIGS. 7A-7C show an embodiment where two portable riser 100 units may be joined using at least one coupling bracket 710 that is preferably fastened to the underside of the first and third level deck 5. FIG. 7D illustrates Detail D of the coupling bracket 710 used to couple the two portable risers of FIG. 7B. The coupling brackets 710, also shown in FIGS. 5E-5F, are preferably constructed of a round metal bar formed into a C-shaped hook. Two formed metal brackets 712 and 714 can be welded to the formed round bar 710 and fastened to the underside of the deck 5. In order to join two or more portable risers 100, the operator positions an upright and locked portable 100 riser next to another erect portable riser 100, then lifts the edge of one portable riser onto the coupling bracket of the other. Those of ordinary skill in the art will recognize that more portable risers could be connected in a similar fashion and that other coupling means can be used.

Figure 8:
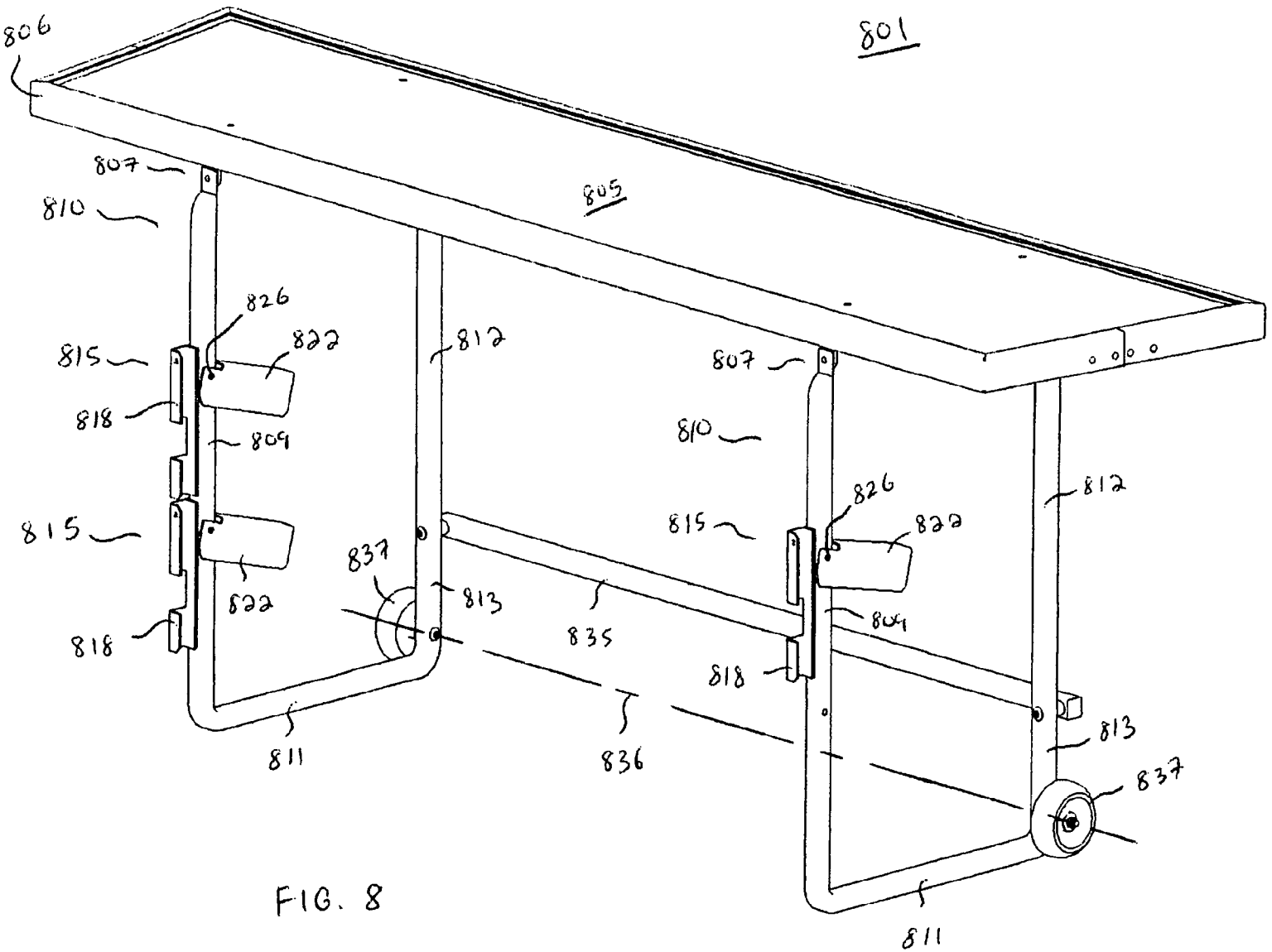
FIG. 8 illustrates an auxiliary deck that can be attached a portable riser structure according to an embodiment of the present invention.
Figures 10A, 10B:
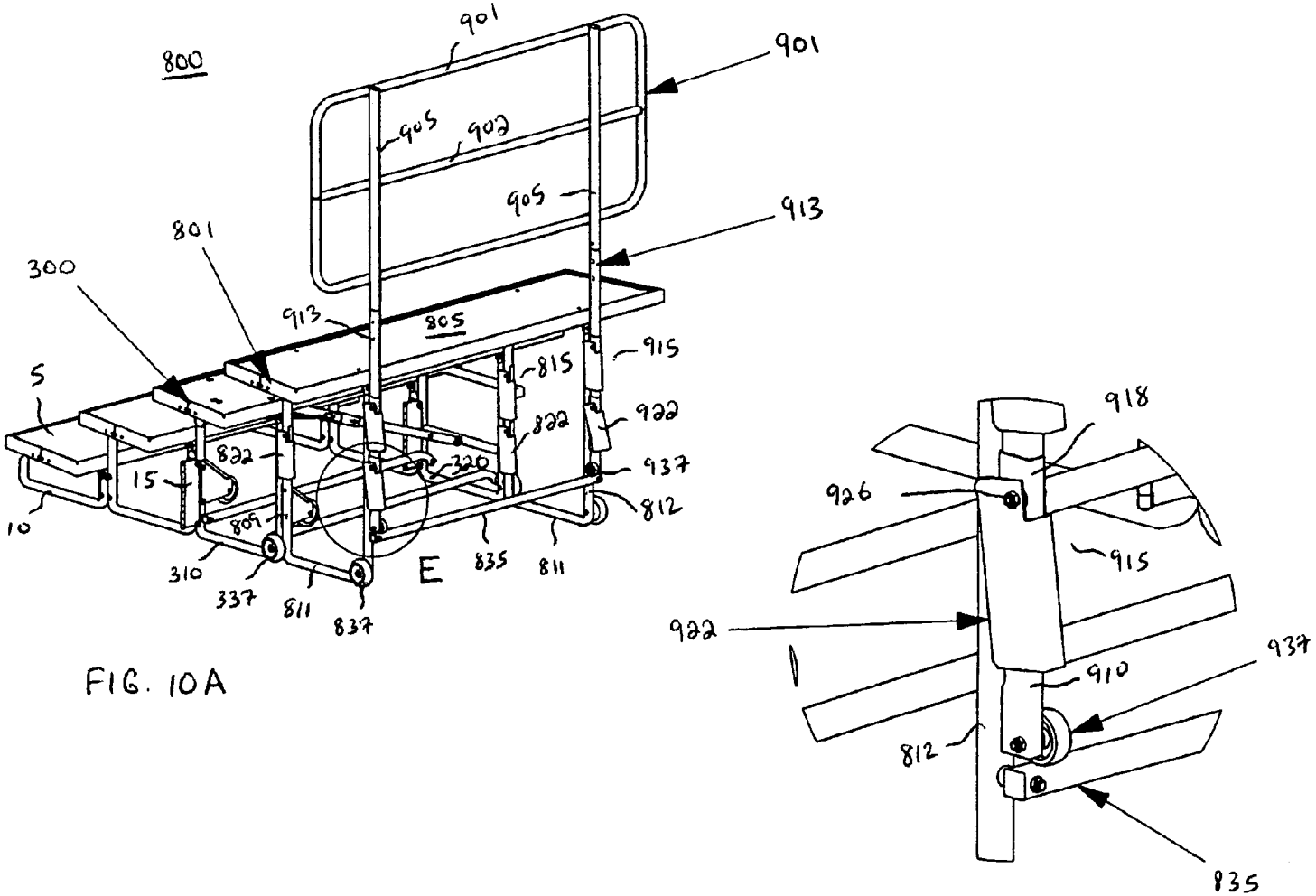
FIG. 10A illustrates a rear isometric view of an upright and locked portable riser having an auxiliary deck and a back rail assembly according to an embodiment of the present invention.
FIG. 10B illustrates Detail E of a locking clamp used to couple the back rail assembly to the portable riser in FIG. 10A.
Figure 11:
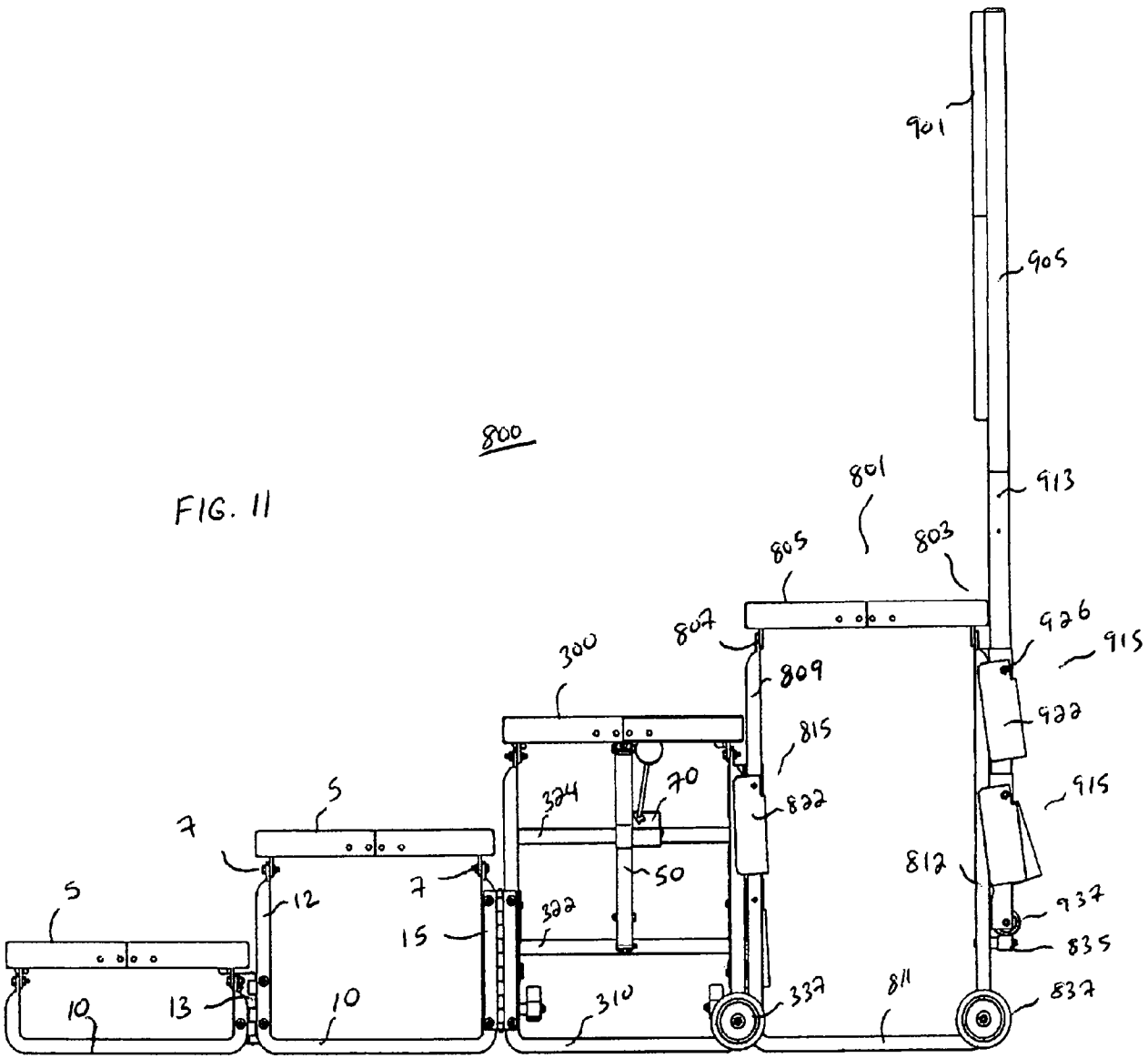
FIG. 11 illustrates a side view of the portable riser having an auxiliary deck and a back rail assembly of FIG. 10A.

FIGS. 8, 10A and 11 show an embodiment of an auxiliary or separate fourth deck 801 that can be coupled or attached to the main portable riser structure 100 of FIGS. 1A-1E, 2-3, 7A-7C to create a four-deck portable riser 800. FIGS. 10A and 11 show rear isometric and side views of the four-deck portable riser 800 in an upright and locked position. The auxiliary deck 801 provides the portable riser 800 with added capacity and can be used on an as-needed basis by a user. As best shown in, FIGS. 10A and 11, the auxiliary deck 801 attaches directly to the rear or the portable riser 100 and preferably adjacent to the third deck section 300. In one embodiment, the auxiliary deck 801 comprises a platform 805, a pair of support legs 810, at least two sets of locking clamps 815, a cross-brace or stabilizer tube 835, and a pair of auxiliary positioner wheels or rollers 837.

The platform 805 is supported by a support frame 806 having pivot points 807 for the attachment of the support legs 810, which in this embodiment are U-shaped legs. The U-shaped support legs 810 and platform 805 preferably have a configuration and structure similar to that discussed previously with respect to the portable riser 100, however, other configurations may also be used. The horizontal base portion 811 contacts the floor while the front and rear vertical leg sections 809 and 812 can vary and have a height selected to appropriately complement the height of the planar deck 805 in the progression of steps in the portable riser 800 to which the auxiliary deck 801 will be attached. The support legs 810 are connected to the pivot points 807 in such a manner that the support legs 810 are free to pivot underneath the platform 805. This configuration permits the auxiliary deck 801 to be collapsible or foldable for ease of storage and transport when not in use. When the auxiliary deck 801 is collapsed, the support legs 810 have rotated with respect to the deck 805 and are substantially parallel with the underside of the deck 805. In the upright position, shown in FIGS. 8, 10A and 11, the support legs 810 are perpendicular to the deck 805.

The stabilizer tube or cross-brace 835 is generally an elongated steel tube or member that spans the distance between the support legs 810 and is attached to and links the support legs 810 to provide stability and support to the auxiliary deck 801. The stabilizer tube 835 is preferably attached to a lower back portion 813 of the support legs 810. The cross-race 835 can serve as a base for a portable riser back rail assembly 900, discussed below and shown in FIGS. 10A and 11.

The auxiliary deck 801 comprises at least one leg locking clamp 815 having a first U-shaped clamp section 818, a rotatable U-shaped clamp section 822 and a rotate axis member 826. The locking clamp 815 is preferably positioned on the front vertical leg section 809 of the support leg 810. The locking clamps 815 cooperatively connect or couple the auxiliary deck 801 to the adjacent support legs 310 and 320 of the portable riser 800. As shown in FIG. 8, the locking clamp 815 preferably has a fixed clamp section 818 fixed to an exterior portion of the front vertical leg section 809. The fixed clamp section 818 is oriented such that the portable riser support legs 310 and 320 will be positioned inside the fixed clamp section 818 when the auxiliary deck 801 is attached to the third deck section 300, as shown in FIGS. 10A and 11. The rotatable clamp section 822 is coupled to the front vertical leg section 809 via the rotate axis member 826 such that it can rotate between a locked and unlocked position. FIG. 8 shows the locking clamp 815 in a unlocked position, while FIGS. 10A and 11 show the leg locking clamp 815 in a locked position. In the locked position, the rotatable clamp section 822 substantially encloses a portion of the front vertical leg 809 and a portion of the adjacent support legs 310 and 320 to thereby lock the auxiliary deck 801 to the rest of the portable riser structure 800, as shown in FIGS. 10A and 11.

The rotate axis member 826 is preferably a bolt and nut fastener combination that secures the rotate-able clamp section 822 to the front vertical leg 809. The bolt and nut combination can be appropriately tightened to ensure that the rotatable clamp section 822 is not loose when it is set in either the locked or unlocked position. Other fastening means for the rotatable clamp section 822 can be used as well, for example a pin or rivet. In the embodiment shown in FIGS. 8, 10A and 11, the portable riser 800 comprises three support leg locking clamps 815, however, more or fewer locking clamps can be used to couple the auxiliary deck 801 to the adjacent support legs 310 and 320. Further, the rotatable clamp section 822 shown has a U-shaped configuration, however other configurations may also be used, so long as the portable riser support legs 310 and 320 can be secured when the auxiliary deck 801 is coupled to the third deck section 300 and the rotatable clamp section 822 can substantially enclose the front vertical leg 809 and the adjacent support legs 310 and 320 thereby locking the auxiliary deck 801 to the rest of the portable riser structure 800.

The auxiliary positioner wheels 837 are preferably mounted or placed such that their axis of rotation 836 is substantially perpendicular to the vertical section 812 of the support legs 810. The auxiliary positioner wheels 837 are preferably cantilevered off the leg frame 810 and are positioned close to the leg base 811 so that when the portable riser 800 is fully upright in the use position, the positioner wheels 837 do not contact the floor. The cantilevered positioner wheels 837 provide a means to move and position an upright and locked portable riser 800, shown in FIGS. 10A and 11. In the upright and locked position, an operator can grasp the lowest deck 5 and lift the portable riser 800 upward. As the operator lifts the portable riser 800, the positioner wheels 837 contacts the floor and the weight of the riser is transferred to the positioner wheels 837. Once the portable riser 800 has been lifted past a weight transfer point only the positioner wheels 837 contact the floor and the raised portable riser 800 can be easily maneuvered and repositioned by the operator.

When the auxiliary deck or fourth level 801 is to be used and attached to the main portable riser structure 800, an operator would first unfold the auxiliary deck 801 from a folded or collapsed position and set it in an upright position. The operator would then line up the upright auxiliary deck 801 with rear of the third deck section 300. The operator would move and adjust the auxiliary deck 801 such that the portable riser support legs 310 and 320 are positioned inside corresponding fixed clamp sections 818. The rotatable clamp section 822 is then rotated from an unlocked position to a locked position, as shown in FIGS. 10A and 11, where the rotatable clamp section 822 substantially encloses a portion of the front vertical leg 809 and the adjacent support legs 310 and 320 inside the leg locking clamp 815. The coupling of the auxiliary deck 801 to the portable riser 800 can be done by a single operator. However, if the portable riser 800 is too bulky and large, more than one operator may carry out these operations to facilitate the movement, lining up and attaching the auxiliary deck 801.

Figure 9:
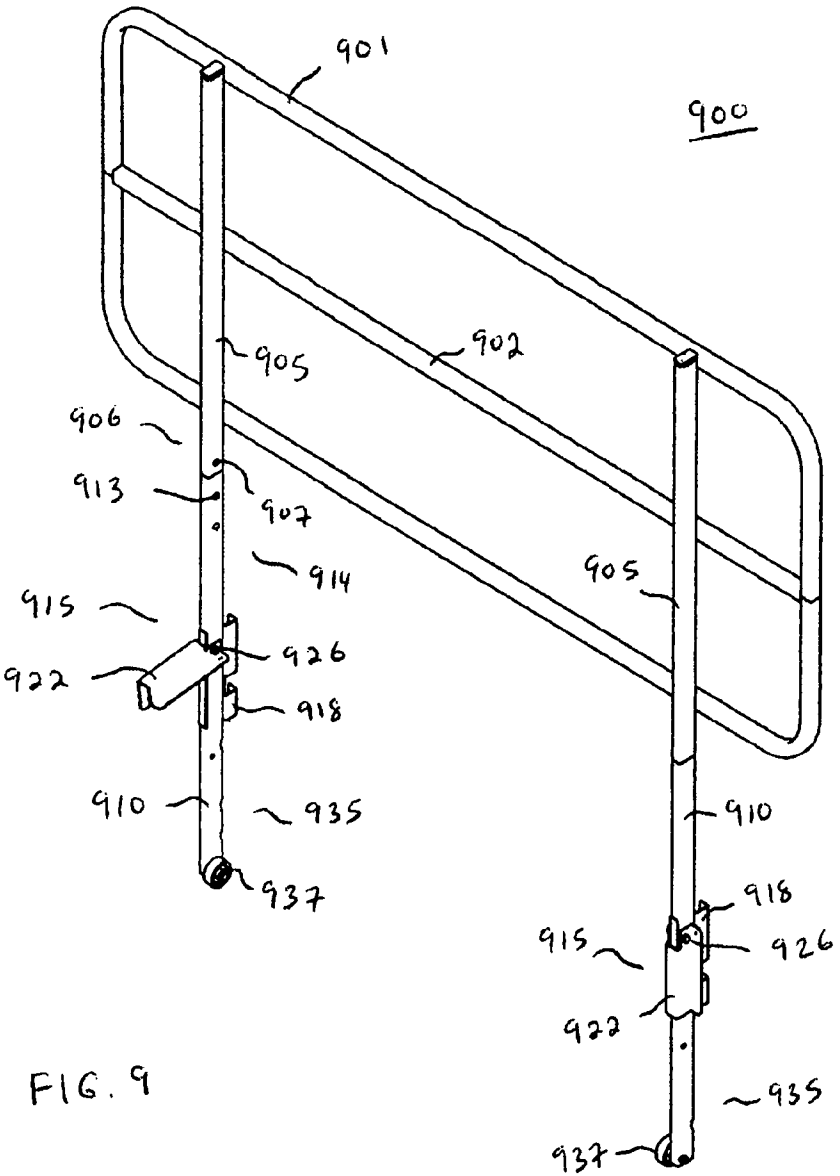
FIG. 9 illustrates a back rail assembly that can be attached to a portable riser structure according to an embodiment of the present invention.

FIG. 9 shows one embodiment of a back rail assembly 900 that can be used with a portable riser structure 100 and 800 that has either three or four riser decks 5 and 805. The back rail assembly 900 can be used as a safety feature for the portable riser 100 and 800 to provide a safety barrier between the rear edge of the third level 300 or fourth level 801 of the portable riser platform or deck 5 and 805 and the floor or ground below. FIGS. 10A and 11 show rear isometric and side views of the back rail assembly 900 coupled to a four-deck portable riser structure 800 via the rear support legs 812 of the auxiliary deck 801. In one embodiment, shown in FIG. 9, the back rail assembly 900 comprises a back rail frame 901, at least two rail frame supports 905, at least two frame upright supports 910 with corresponding engage spring clips 913, a least one frame rail locking clamp 915, and an upright support wheel 937.

The back rail frame 901 is preferably made of steel tubing and has a substantially rectangular configuration and size that, when installed, spans the rear platform edge 803 of either the third deck 300 or auxiliary deck 805. The back rail frame 901 also has a frame cross-brace 902 for added stability and strength. The back rail frame 901 is attached to a pair of rail frame supports 905 that enable the back rail frame 901, in conjunction with the frame upright supports 910, to be appropriately positioned on the rear of the portable riser 100 and 800. The rail frame support 905 comprises one or more frame support orifices or apertures 907 on a lower frame support end 906. As best shown in FIG. 10A, the frame supports 905 are positioned on the back rail frame 901 such that the frame supports 905 are aligned with the portable riser support legs 810, and in particular with the rear vertical leg section 812. The back rail frame 901 and rail frame supports 905 are preferably zinc plated steel tubing, however, other types of materials may be used.

As shown in FIGS. 9-11, the frame upright support 910 comprises an engage spring clip 913, a least one frame rail locking clamp 915, and an upright support wheel 937. The engage spring clip 913 is positioned in an upper end 914 of the frame upright support 910 and interacts with a corresponding rail frame support aperture 907 to secure the back rail assembly 900 to the portable riser 800. Those of ordinary skill in the art will readily recognize that other securing or coupling means may be used to attach the back rail frame 901 to the frame upright support 910. In one embodiment, the engage spring clip 913 is a spring biased pin that extends outwardly from the upper end 914 of the frame upright support 910. The engage spring clip 913 can be retracted by application of a compressing force on the engage spring clip 913. When the compressing force is removed or released, the engage spring clip 913 expands via the extending biasing spring.

On an opposite lower end 935, the frame upright support 910 can serves, if used, as an attachment point for an upright support wheel 937. Use of the upright support wheel 937 on the frame upright supports 910, in the case of a three-deck portable riser 100, enables an upright portable riser unit 100 to be moved, positioned and adjusted after the back rail assembly 900 has been installed. When the auxiliary deck or level 801 is used, as shown in FIGS. 10A and 11, the rail frame supports 905 and frame upright supports 910 are not long enough to rest on the floor or ground below. In this case, back rail assembly 900 frame upright supports 910 can be positioned on the stabilizer tube 835 of the auxiliary deck 801 for additional support of the back rail assembly 900.

The back rail assembly 900 comprises at least one frame rail locking clamp 915 substantially similar to the locking clamp 815 of the auxiliary deck 801 discussed previously, The frame rail locking clamp 915 has a fixed clamp section 918, a rotatable clamp section 922 and a rotate axis member 926. The frame rail locking clamp 915 is preferably positioned in a mid-section of the frame upright support 910 such that when the back rail assembly 900 is installed, as shown in FIGS. 10A-11, the back rail assembly 900 provides a safety barrier between the rear edge 803 of the portable riser platform 800 and the floor below. The frame rail locking clamp 915 cooperatively connects or couples the frame upright support 910 to the rear vertical section 812 of the support legs 810 of the auxiliary deck 800. It will be readily apparent to those of ordinary skill in the art that the back rail assembly 900 can be used in a portable riser 100 and 800 with either three or four levels, and that the back rail assembly 900 attaches directly to the rear vertical section of the support legs 310, 320, 810.

FIG. 9 shows a the fixed clamp section 918 is fixed to an exterior portion of the frame upright support 910. The fixed clamp section 918 is oriented such that the rear vertical section 812 of the support leg 810 can be positioned inside the fixed clamp section 918 to couple the frame upright support 910 to the auxiliary deck section 801, as depicted in FIGS. 10A-11. The rotatable clamp section 922 is coupled to the frame upright support 910 via the rotate axis member 926 such that it can rotate between a locked and unlocked position. FIG. 9 shows the frame rail locking clamp 915 in an unlocked position, while FIGS. 9-11 show the frame rail locking clamp 915 in a locked position. In the locked position, the rotatable clamp section 922 encloses the frame upright support 910 and a portion of the rear vertical section 812 of the support leg 810 to thereby lock or secure the frame upright support 910 to the portable riser structure 800, as shown in FIGS. 10A-11.

Similar to the locking clamp 815 of the auxiliary deck 801, the rotate axis member 926 of the frame rail locking 915 is preferably a bolt and nut fastener combination that secures the rotatable clamp section 922 to the frame support upright 910. The bolt and nut combination is appropriately tightened to ensure that the rotatable clamp section 922 does not loosen when it is set in either the locked or unlocked position. FIGS. 9-11, illustrate that the frame upright support 910 can comprises one or two frame rail locking clamps 915, however, more or less locking clamps can be used to attach the back rail assembly 900 to the rear vertical leg section 812 of the portable riser 800. Further, the rotatable clamp section 922 can have other configurations that enable the rear vertical section 812 to be positioned inside the fixed clamp section 918 when the frame upright supports 910 are coupled to the portable riser support legs 810 and that enable the rotatable clamp section 922 to substantially enclose the frame upright support 910 and a portion of the rear vertical section 812 to thereby lock or secure the back rail assembly 900 to the portable riser structure 800.

When the back rail assembly 900 is to be used and attached to the main portable riser structure 800, for example as shown in FIGS. 9-11, the operator would first attach the frame upright support 910 to the rear vertical section 812 of the portable riser 800. This can be done by positioning the fixed clamp section 918 on the rear vertical section 812 of the support leg 810. The final position of the frame upright support 910 on the rear vertical section 812 is selected to provide an optimum safety barrier height between the rear edge of the portable riser 800 and the floor or ground below. The rotatable clamp section 922 is then rotated or moved to a locked position where the rotatable clamp section 922 substantially encloses the frame upright support 910 and a portion of the rear vertical section 812 of the support leg 810. This locks the frame upright support 910 in place. This process is carried out for both frame upright supports 910 which are preferably positioned in identical heights above the floor, though different heights may also be used.

Once both frame upright supports 910 are securely attached, the back rail frame 901 with its rail frame supports 905 can be attached to the previously attached frame upright supports 910. The back rail frame 901 is aligned such that the rail frame supports 905 can be lowered in a telescoping relationship onto corresponding frame upright supports 910. The rail frame supports 905 are lowered onto the frame uprights supports 910 until the rail frame supports 905 encounter the engage spring clips 913. The engage spring clips 913 can be automatically compressed or contracted by the descending rail frame supports 905 or the engage spring clips 913 can be manually compressed to permit the rail frame supports to continue descending onto the frame upright supports 910. As the rail frame supports 905 continue to descend, the frame support apertures 907 reaches the engage spring clips 913. When the frame support apertures 907 are aligned or coincident with the engage spring clips 913, the engage spring clips 913 will expand and insert or snap into the frame support apertures 907. The inserted engage spring clips 913 will prevent further movement or descent of the rail frame supports

905 thereby locking the back rail frame 901 in place, as shown in FIGS. 10A and 11. Removal or disassembly of the back rail assembly 900 can be accomplished by executing the previous steps in reverse order.

The invention has been described and illustrated with respect to certain preferred embodiments by way of example only. Those skilled in that art will readily recognize that the preferred embodiments may be altered or amended without departing from the true spirit and scope of the invention. For example, the portable riser legs, support brackets, and telescoping brace mechanism are all constructed of tubular steel or aluminum, however, any other suitable material can be used. Also, the telescoping brace mechanism and the number of deck levels and their respective heights may vary according to a particular use or application and are not limited to the embodiments described above. Therefore, the invention is not limited to the specific details, representative devices, and illustrated examples in this description. The present invention is limited only by the following claims and equivalents.

What is claimed is:

1. A portable riser including a plurality of riser decks having a deck frame with a first end and an opposite second end and a first and second support legs, the portable riser having a collapsed position and an upright position, the portable riser comprising:

a user-actuated lifting assist assembly including a telescoping cross-brace having a variable length, the cross-brace comprising an outer tube receiving an inner tube and a gas cylinder interiorly coupled to the inner tube and the outer tube, the cross-brace and the gas cylinder coupled to the first end of the deck frame at one end and an attachment point on the first support leg at a second end such that the cross brace and the gas cylinder rotate about the attachment point when the riser is moved between an upright position and a collapsed position, whereby the length of the cross-brace changes as the riser moves between a collapsed position and an upright position such that when the riser is in the collapsed position the length of the cross-brace is less than the length of the cross-brace when the riser is in the upright position, wherein the gas cylinder generates a substantially horizontal extending force when the riser is in a collapsed position and generates an upward extending force when the first end of the riser deck is raised a sufficient amount to rotate the gas cylinder such that the gas cylinder extends generally upward from the attachment point, the lifting assist assembly providing a lifting force to move the portable riser to an upright position.

2. The portable riser of claim 1, further comprising:

a first pivot mechanism coupled to the first support leg and adapted to initiate upward movement of the portable riser from the collapsed position upon introduction of a downward force by a user on the first support leg; and, a second pivot mechanism coupled to the second support leg and adapted to supplement the upward movement.

3. The portable riser of claim 2, wherein said first pivot mechanism comprises a set of wheeled caster brackets attached to the first support leg and corresponding pivot bracket wheels.

4. The portable riser of claim 3, wherein the second pivot mechanism comprises a U-shaped cross bar attached to an exterior section of the second support leg.

5. The portable riser of claim 1, wherein the inner and outer tubes have a substantially square or rectangular cross section configuration.

6. A portable riser including a plurality of riser decks having a deck frame with a first end and an opposite second end and first and second support legs, the portable riser having a collapsed position and an upright position, the portable riser comprising:

a user-actuated lifting assist assembly including a telescoping cross-brace having a variable length, the cross-brace comprising an outer tube receiving an inner tube and a gas cylinder interiorly coupled to the inner tube and the outer tube, the cross-brace and the gas cylinder coupled to the first end of the deck frame at one end and an attachment point on the first support leg at a second end such that the cross brace and the gas cylinder rotate about the attachment point when the riser is moved between an upright position and a collapsed position, whereby the length of the cross-brace changes as the riser moves between a collapsed position and an upright position such that when the riser is in the collapsed position the length of the cross-brace is less than the length of the cross-brace when the riser is in the upright position.

7. The portable riser of claim 6 wherein the gas cylinder is compressed when the riser is in a collapsed position.

* * * * *